US011047075B2

(12) United States Patent
Lonati et al.

(10) Patent No.: US 11,047,075 B2
(45) Date of Patent: Jun. 29, 2021

(54) METHOD FOR THE PRODUCTION OF PORTIONS OF MANUFACTURE BY MEANS OF A CIRCULAR KNITTING MACHINE WITH NEEDLE CYLINDER THAT CAN BE ACTUATED WITH AN ALTERNATING ROTARY MOTION ABOUT ITS OWN AXIS

(71) Applicant: Lonati S.P.A., Brescia (IT)

(72) Inventors: Ettore Lonati, Botticino (IT); Fausto Lonati, Brescia (IT); Francesco Lonati, San Felice del Benaco (IT)

(73) Assignee: LONATI S.P.A., Brescia (IT)

( * ) Notice: Subject to any disclaimer, the term of this patent is extended or adjusted under 35 U.S.C. 154(b) by 0 days.

(21) Appl. No.: 16/965,247

(22) PCT Filed: Aug. 31, 2018

(86) PCT No.: PCT/EP2018/073519
§ 371 (c)(1),
(2) Date: Jul. 27, 2020

(87) PCT Pub. No.: WO2019/149387
PCT Pub. Date: Aug. 8, 2019

(65) Prior Publication Data

US 2021/0062376 A1 Mar. 4, 2021

(30) Foreign Application Priority Data

Feb. 1, 2018 (IT) ..... 102018000002290

(51) Int. Cl.
*D04B 1/10* (2006.01)
*D04B 1/26* (2006.01)

(52) U.S. Cl.
CPC ..... *D04B 1/102* (2013.01); *D04B 1/108* (2013.01); *D04B 1/26* (2013.01)

(58) Field of Classification Search
CPC ..... D04B 1/12; D04B 1/102; D04B 1/104; D04B 1/108; D04B 9/26; D04B 9/36; D04B 9/28
See application file for complete search history.

(56) References Cited

U.S. PATENT DOCUMENTS 2,009,694 A 7/1935 Houseman
6,722,163 B2 * 4/2004 Ando' ..... D04B 1/108 66/51

(Continued)

FOREIGN PATENT DOCUMENTS

WO WO 2015/181714 12/2015

OTHER PUBLICATIONS

Italian Search Report and Written Opinion from IT 201800002290.
Search Report and Written Opinion for PCT/IB2015/053921.

*Primary Examiner* — Danny Worrell
(74) *Attorney, Agent, or Firm* — Husch Blackwell LLP

(57) ABSTRACT

A method for the production of portions of manufacture by means of a circular knitting machine with needle cylinder, which comprises the following steps:

identifying a group of contiguous needles in the needle cylinder;

dividing the group of needles into two contiguous needle subgroups, respectively a first needle subgroup and a second needle subgroup;

moving to knit at a feed or drop of the machine a needle subgroup of the two needle subgroups during rotation of the needle cylinder in one direction and in the subsequent rotation in the opposite direction to form two partial rows of knitting in succession;

moving to knit at the feed the other needle subgroup of the two needle subgroups during the rotation of the needle cylinder in one direction of rotation and in the subse- (Continued)

quent rotation in the opposite direction to form two partial rows of knitting in succession;

moving to knit at the feed the other needle subgroup of the two needle subgroups during the rotation of the needle cylinder in one direction of rotation and in the subsequent rotation in the opposite direction to form two partial rows of knitting in succession.

7 Claims, 19 Drawing Sheets

(56) References Cited

U.S. PATENT DOCUMENTS

| | | | | |
|---|---|---|---|---|
| 7,191,622 | B1 * | 3/2007 | Walker | D04B 1/12 66/180 |
| 7,213,417 | B2 * | 5/2007 | Lonati | D04B 1/126 66/8 |
| 7,738,991 | B2 * | 6/2010 | Klumpp | D04B 1/26 66/185 |
| 2003/0182974 | A1 | 10/2003 | Ando | |

* cited by examiner

METHOD FOR THE PRODUCTION OF PORTIONS OF MANUFACTURE BY MEANS OF A CIRCULAR KNITTING MACHINE WITH NEEDLE CYLINDER THAT CAN BE ACTUATED WITH AN ALTERNATING ROTARY MOTION ABOUT ITS OWN AXIS

The present invention relates to a method for the production of portions of manufacture by means of a circular knitting machine with needle cylinder that can be actuated with an alternating rotary motion about its own axis.

As is known, circular hosiery knitting machines comprise a needle cylinder which is arranged so that its axis is vertical and has, on its lateral surface, a plurality of axial slots inside each of which a needle is accommodated which can slide along the corresponding axial slot. Each needle is provided with a heel that protrudes radially from the lateral surface of the needle cylinder and around the needle cylinder there are needle actuation cams which define paths with which the heels of the needles engage. Laterally to the needle cylinder there is at least one feed or drop at which yarn fingers are arranged which have the function of dispensing one or more yarns to the needles.

The paths defined by the needle actuation cams are shaped so as to cause, as a consequence of the actuation of the needle cylinder with a rotary motion about its own axis with respect to the needle actuation cams and to the drop or feed, the movement of the needles along the corresponding axial slot in order to grip the yarn or yarns dispensed by the yarn fingers at the feed or drop and the forming of new loops of knitting on the part of the needles.

Inside each axial slot of the needle cylinder, below each needle, generally there is a selector and optionally a sub-needle, which is interposed between the selector and the needle. The selector cooperates with one or more selection devices, which face laterally the needle cylinder and have the task of selecting the needles of the machine that must be moved to knit, i.e., to pick up the yarn or yarns, at a given feed or drop. The selectors and often also the sub-needles are provided with corresponding heels which protrude radially from the lateral surface of the needle cylinder and can engage corresponding actuation cams arranged around the needle cylinder in order to cause the movement of the selectors and/or of the sub-needles along the axial slots of the needle cylinder in which they are arranged. The movement of the selectors and/or of the sub-needles has the effect of causing or allowing the movement of the corresponding overlying needle and this movement can be used to actuate directly the needle or to vary the path followed by the heel of the needle and defined by the needle actuation cams.

In some types of circular hosiery knitting machine, the needle cylinder can be actuated with a rotary motion about its own axis in the two directions of rotation with respect to the actuation cams and the feeds or drops in order to perform, particular kinds of knitting which indeed require the actuation of the needle cylinder with an alternating rotary motion about its own axis. One of these kinds of knitting is constituted by the execution of the region of the heel and of the region of the toe of hosiery in circular hosiery knitting machines. A similar knitting is performed on circular knitting machines to provide pouches or to obtain contoured portions on the manufactures.

In these machines, the set of the actuation cams of the needles and/or of the selectors and/or of the sub-needles defines paths which are capable of actuating the needles to form knitting at at least one feed or drop of the machine both in one direction of rotation of the needle cylinder and in the opposite direction.

Generally, for types of knitting that require an actuation with an alternating rotary motion of the needle cylinder about its own axis with respect to the actuation cams of the needles and the actuation cams of the selectors and/or sub-needles, a feed or drop of the machine is used and the needle actuation cams comprise a central cam, which is triangular and arranged at the feed, and two knockover cams, which are arranged on mutually opposite sides with respect to the feed, i.e., with respect to the central cam.

For kinds of knitting performed by means of the alternating rotation of the needle cylinder about its own axis, a reduced number of needles is generally used, said needles being arranged in the axial slots formed on the lateral surface of the needle cylinder in a limited sector of the needle cylinder.

The limitation of the number of needles used for these kinds of knitting is dictated by production-related requirements, as in the case of the heel or toe of hosiery, and by operating requirements of the machine, since in order to be able to reverse the direction of rotation of the needle cylinder the needles must have their heel in very precise regions of the paths defined by the needle actuation cams, i.e., regions that allow to reverse the motion of the needles with respect to the cams without causing damage to the machine or knitting defects.

More particularly, considering the operation of a traditional machine during the execution of the heel of a hosiery item, the knitting is produced by using a group of contiguous needles and by actuating the needle cylinder with an alternating rotary motion about its own axis, i.e., producing in each instance one row of knitting by rotating the needle cylinder clockwise and one row of knitting by rotating the needle cylinder counterclockwise. The yarn, which is fed to the group of needles at the feed or drop assigned to this knitting, upon reversal of the motion of the needle cylinder is taken up by means of adapted devices so that said yarn turns around the last needle that is knitting, i.e., that has taken the yarn, and is ready for the next row of knitting. In order to create the pouch of the heel, the number of needles of the needle group that are moved to knit at the assigned feed is decreased progressively by excluding from knitting, at each reversal of the motion of the needle cylinder, at least one needle located at the end of the group of needles that has knitted to form the last row of knitting and by then progressively returning to knit, in reverse sequence, in each instance, the needles that previously had been excluded from knitting.

The exclusion from knitting and return to knitting of the needles is performed, in many types of machine, by means of the selection devices which, by means of the selectors and/or sub-needles, act on the needles so as to vary the path of the actuation cams with which the heel of the needles engages. Generally, in the set of needle actuation cams there is a path that is lower than the other paths or a path that is higher than the other paths and, by virtue of the action of the selection devices, is engaged by the heel of the needles to be excluded from knitting so that the corresponding needles are located with their tip too low or too high to be able to take up the yarn dispensed at the feed being used.

In many machines that use selection devices of the mechanical or electronic type, selection of the needles that must be moved to knit during the rotation of the needle cylinder in one direction is performed during the rotation of the needle cylinder in the directly preceding opposite direction. More particularly, during the rotation of the needle cylinder in one direction, after a needle has formed a new loop of knitting by knocking over the previously formed loop of knitting, i.e., directly downstream or even at the knockover cam used for that direction of rotation, if said needle must be moved to knit during the subsequent rotation of the needle cylinder in the opposite direction, it is selected by the selection device and moved to the tuck-stitch position. If instead said needle must be excluded from knitting during the subsequent rotation of the needle cylinder in the opposite direction, it is retained or moved with its heel in the lower path.

In machines of this kind there is a limit to the number of needles that can be used during knitting with an alternating rotation of the needle cylinder, since the number of needles that are always excluded from knitting must be adequately greater, depending on the type of machine and on its actuation system, than the number of needles that lies within the angular distance that exists between the end of the rising ramp, depending on the direction of rotation of the needle cylinder, of the two cams that cause the lifting of the needles in the tuck-stitch position, located on mutually opposite sides with respect to the feed used in knitting with an alternating rotary motion of the needle cylinder. The cams that cause the rise of the needles in the tuck-stitch position can belong to the set of needle actuation cams or to the set of the actuation cams of the selectors and/or sub-needles.

One example of a machine of this kind is shown in FIGS. 18 and 19, which refer to a machine with a needle cylinder on the lateral surface of which there is a plurality of axial slots, each of which accommodates internally a needle 1-144 and, below said needle, a selector 145, as well as a sub-needle 146, between the selector 145 and the needle 1-144. FIGS. 18 and 19 are schematic flat projection views of the needle actuation cams 150, of the selector actuation cams 160 and of the sub-needle actuation cams 170 of a circular hosiery knitting machine. Laterally to the flat projection view of the cams 150, 160, 170, in FIGS. 18 and 19, there is a needle 1-144, a sub-needle 146 and a selector 145, which are rotated through 90° with respect to the actual position and are accommodated in a same axial groove of the needle cylinder. In these figures, the reference numeral 152 designates the central cam, the reference numerals 153 and 154 designate the knockover cams, the reference numerals 201 and 202 designate the direction of motion of the needles 1-144, or of the needle cylinder, with respect to the needle actuation cams 150 and the cams 160, 170, and the reference numeral 180 designates the feed or drop at which the yarn fingers 181 are arranged. The needles are identified by progressive numerals from 1 to 144, but only some needles required for the comprehension of the described problem have been numbered. The heels 151 of the needles selected to knit at the feed 180 in the subsequent reverse rotary motion are shown in black, while the heels 151 of the needles that must remain excluded from knitting are shown in white. The heels 161 of the selectors 145 and the heels 171 of the sub-needles 146 have been drawn with the same criterion. The other elements of the machine shown in these figures will be described hereinafter. The two FIGS. 18 and 19 show the situation at the end of a motion in one direction 201 and at the end of the motion in the opposite direction 202 of the needle cylinder or of the needles with respect to the needle actuation cams 150 and the cams 160, 170. As can be seen, the exclusion from knitting of a limited number of needles, twenty-four needles in the illustrated case, does not allow to work correctly, since completion of needle selection, which is performed by means of the selection device 191 directly downstream of the knockover cam 153 in FIG. 18 and by means of the selection device 192 directly downstream of, or better still at, the knockover cam 154 in FIG. 19 would move the first needle selected to be moved to knit in the subsequent reverse motion (the needle 13 in FIG. 18 and the needle 132 in FIG. 19) to again take up the yarn at the feed 180, producing a knitting error in both directions of rotation. Furthermore, some needles would enter between the knockover cams 153 and 154 incorrectly, causing further knitting errors upon motion reversal.

In machines that perform selection of the needles that must be moved to knit at the feed being considered during the rotation of the needle cylinder in one direction while the needle cylinder is performing the rotation in the same direction, this problem of the limitation of the needles that can be used in the alternating rotary motion of the needle cylinder does not exist and therefore with these machines there is greater versatility in use as regards the kinds of knitting that require an alternating rotation of the needle cylinder about its own axis.

In view of this prior art, the need is felt to be able to produce portions of manufactures produced by actuating the needle cylinder with an alternating rotary motion about its own axis with rows of knitting that have a large number of stitches, in an extreme case equal to the number of needles of the machine, even with circular machines that perform selection of the needles to be moved to knit during the rotary motion of the needle cylinder in one direction, during the rotation of the needle cylinder in the immediately preceding opposite direction.

The aim of the present invention is to meet this requirement, by devising a method for the production of portions of manufacture by means of a circular knitting machine with needle cylinder that can be actuated with an alternating rotary motion about its own axis that allows to use a large number of needles, in an extreme case equal to the number of needles of the machine, even in machines of this kind.

Within this aim, an object of the invention is to provide a method that can be performed without requiring substantial modifications of machines that are already commercially available.

Another object of the invention is to propose a method that does not penalize excessively the production potential of the machines.

This aim, as well as these and other objects which will become better apparent hereinafter, are achieved by a method for the production of portions of manufacture by means of a circular knitting machine with needle cylinder that can be actuated with an alternating rotary motion about its own axis, wherein said needle cylinder has, on its lateral surface, a plurality of axial slots, in each of which a needle is accommodated, a drop or feed being arranged around said needle cylinder and at least one yarn being dispensed thereat which can be engaged by the needles in order to form knitting, means being provided for the actuation of the needles along the corresponding axial slot in order to grip the yarn at said drop or feed and form loops of knitting, selection devices being provided for selecting the needles to be moved to knit at said at least one feed, said selection devices comprising a first selection device and a second selection device, which are arranged on mutually opposite sides with respect to said feed, said selection devices being adapted to select the needles downstream of said feed depending on the direction of rotation of the needle cylinder about its own axis, characterized in that it comprises the following steps:

identifying a group of contiguous needles in the needle cylinder;

dividing said group of needles into two contiguous needle subgroups, respectively a first needle subgroup and a second needle subgroup;

moving to knit at said feed a needle subgroup of said two needle subgroups during the rotation of the needle cylinder in one direction and in the subsequent rotation in the opposite direction to form two partial rows of knitting in succession;

moving to knit at said feed the other needle subgroup of said two needle subgroups during the rotation of the needle cylinder in one direction of rotation and in the subsequent rotation in the opposite direction to form two partial rows of knitting in succession;

proceeding in this manner by alternating, every two partial rows of knitting, the needle subgroup that is moved to knit at said feed for a preset number of partial rows of knitting;

at least one needle of a needle subgroup of said needle subgroups, located proximate to the other needle subgroup, being moved to knit in the forming of at least one of the two partial rows of knitting formed in each instance by the other needle subgroup for the interconnection of the partial rows of knitting formed by a needle subgroup with the partial rows of knitting formed by the other needle subgroup.

Further characteristics and advantages of the invention will become better apparent from the description of a preferred but not exclusive embodiment of the method according to the invention, illustrated by way of nonlimiting example in the accompanying drawings, wherein:

FIGS. 18 and 19 illustrate a conventional machine.

Figure 1:
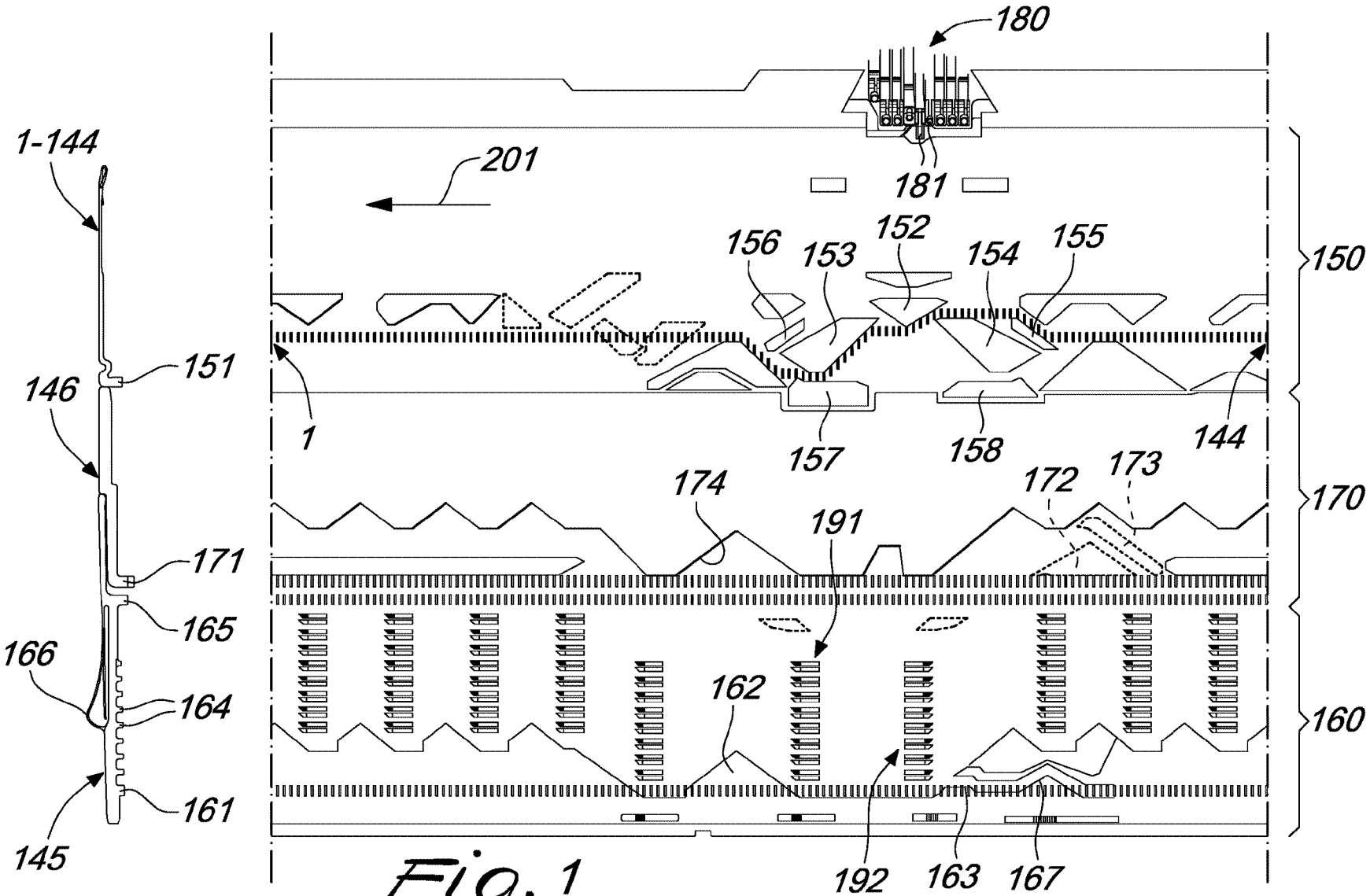
FIGS. 1 to 14 are schematic flat projection views of the actuation cams of the needles, of the sub-needles and of the selectors and of the heels of the needles, of the sub-needles and of the selectors in the execution of the various steps of the method according to the invention.

FIGS. 18 and 19 and FIGS. 1 to 14 show, laterally to the flat projection view of the needle actuation cams 150, of the selector actuation cams 160 and of the sub-needle actuation cams 170, and rotated through 90° with respect to their actual position, a needle 1-144, a sub-needle 146 and a selector 145, which are accommodated in each one of the axial slots formed on the lateral surface of the needle cylinder.

The method according to the invention can be performed with a circular hosiery knitting machine of the known type which comprises a needle cylinder, having a vertical axis, which can be actuated with an alternating rotary motion about its own axis. Said machine has a feed or drop 180 to be used when the needle cylinder is actuated with an alternating rotary motion about its own axis and which, during the rotation of the needle cylinder about its own axis in one direction of rotation, performs the selection of the needles that must knit at the feed 180 during the subsequent rotary motion of the needle cylinder in the opposite direction.

The needle cylinder has, on its lateral surface, a plurality of axial slots, in each of which a needle 1-144 is accommodated.

Around the needle cylinder there is a drop or feed 180 at which at least one yarn is dispensed, by means of one or more yarn fingers 181, and can be engaged by the needles 1-144 in order to form knitting. The machine is provided with means for the actuation of the needles 1-144 along the corresponding axial groove in order to take up the yarn at the mentioned drop or feed 180 and form loops of knitting.

The machine is further provided with selection devices for selecting the needles 1-144 to be moved to knit at the mentioned feed 180 and these selection devices comprise a first selection device 191 and a second selection device 192, which are arranged on mutually opposite sides with respect to the feed 180. These selection devices 191, 192 are adapted to select the needles 1-144 downstream of the feed 180 depending on the direction of rotation of the needle cylinder about its own axis.

More particularly, each needle 1-144 is provided, in a per se known manner, with a heel 151 which protrudes radially from the corresponding axial groove of the needle cylinder and the needle actuation means comprise needle actuation cams 150 which are arranged around the needle cylinder and define paths inside which the heels 151 of the needles 1-144 engage.

In the machine shown schematically in FIGS. 1 to 14, the needle actuation means comprise, inside each one of the axial grooves of the needle cylinder, below each needle 1-144, a selector 145 and a sub-needle 146, which is interposed between the needle 1-144 and the selector 145. Each selector 145 is provided, proximate to its lower end, with a heel 161 and can oscillate, on its plane of arrangement or on a plane that passes through the axis of the needle cylinder, with respect to the needle cylinder in order to pass from an active position, in which the heel 161 protrudes radially from the corresponding axial slot of the needle cylinder, to an inactive position, in which the heel 161 is retracted into the corresponding axial slot of the needle cylinder.

The ability of each selector 145 to oscillate for its transition from the active position to the inactive position and vice versa is obtained by means of an elastic portion 166 of the selector 145 which rests on the bottom of the corresponding axial slot of the needle cylinder and contrasts elastically the transition of the selector 145 from the active position to the inactive position. Each selector 145 is provided with one or more selection tabs 164 on which the selection devices 191, 192 act, in a per se known manner, to cause the transition of the selector 145 from the active position to the inactive position. In the illustrated embodiment, each selector 145 is also provided with a heel 165 in an intermediate region of its extension, proximate to the sub-needle 146.

Each sub-needle 146 also is provided with a heel 171 which protrudes radially from the corresponding axial slot of the needle cylinder.

Around the needle cylinder, at the level of the selectors 145, there are selector actuation cams 160 which can be engaged by the heels 161 of the selectors 145 when they are in the active position. Likewise, around the needle cylinder, at the level of the sub-needles 146, there are sub-needle actuation cams 170 which can be engaged by the heels 171 of the sub-needles 146. The needle actuation cams 150, the sub-needle actuation cams 170 and the selector actuation cams 160 define, for the heels 151, 171 and 161 that engage with them, paths which are contoured to cause, as a consequence of the rotation of the needle cylinder about its own axis with respect to the cams 150, 170, 160, the movement of the needles 1-144, of the sub-needles 146 and of the selectors 145 along the corresponding axial slots of the needle cylinder or the retention of the needles 1-144, of the sub-needles 146 and of the selectors 145 in a given position. More particularly, as regards the needles 1-144, their movement inside the corresponding axial slot of the needle cylinder can be achieved by means of the needle actuation cams 150 or by means of the movement of the corresponding sub-needle 146 and/or of the corresponding selector 145 produced by the sub-needle actuation cams 170 or by the selector actuation cams 160.

The machine shown in FIGS. 1 to 14 is provided with ten selection devices, but only two of these devices, designated by the reference numerals 191, 192, are used for the execution of the method according to the invention. More particularly, the selection device 191, arranged directly downstream of the knockover cam 153 along the direction of rotation of the needle cylinder or of movement of the needles 1-144 with respect to the actuation cams 150, 160, 170 indicated by the arrow 201, is used to perform the selection of the needles that will have to knit at the feed 180 being considered when the needle cylinder is actuated along the opposite direction of rotation, indicated by the arrow 202, while the selection device 192, arranged at or directly downstream of the knockover cam 154, along the direction of rotation of the needle cylinder or of movement of the needles 1-144 with respect to the actuation cams 150, 160, 170 indicated by the arrow 202, is used to perform the selection of the needles that will have to knit at the feed 180 being considered when the needle cylinder is actuated along the opposite direction of rotation, indicated by the arrow 201.

Figure 18:
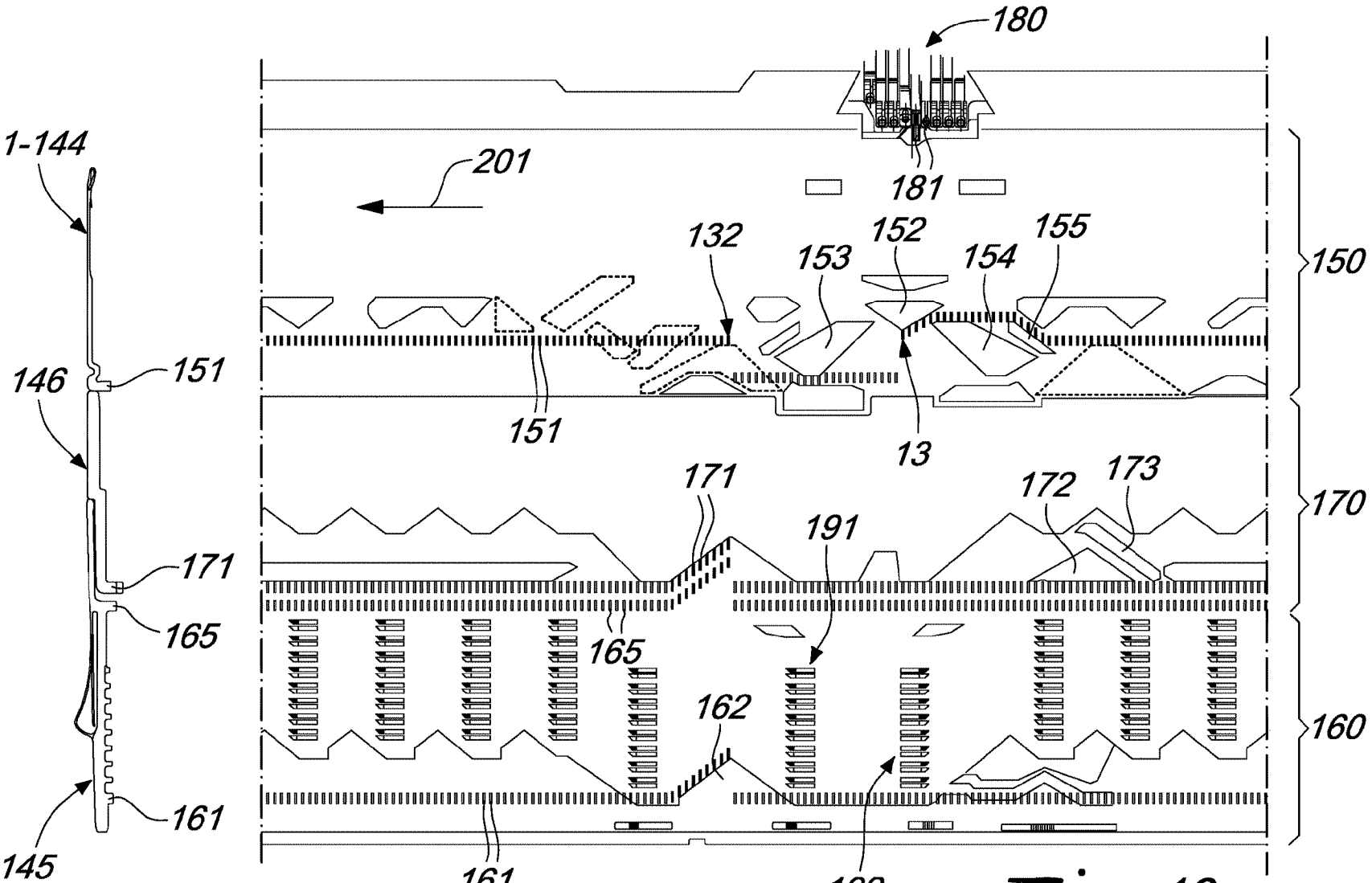
FIGS. 18 and 19 are schematic flat projection views of the actuation cams of the needles, of the sub-needles and of the selectors and of the heels of the needles, of the sub-needles and of the selectors in the production of portions of manufacture with a method of the traditional type which uses the possibility of alternating rotary motion of the needle cylinder about its own axis.
Figure 19:
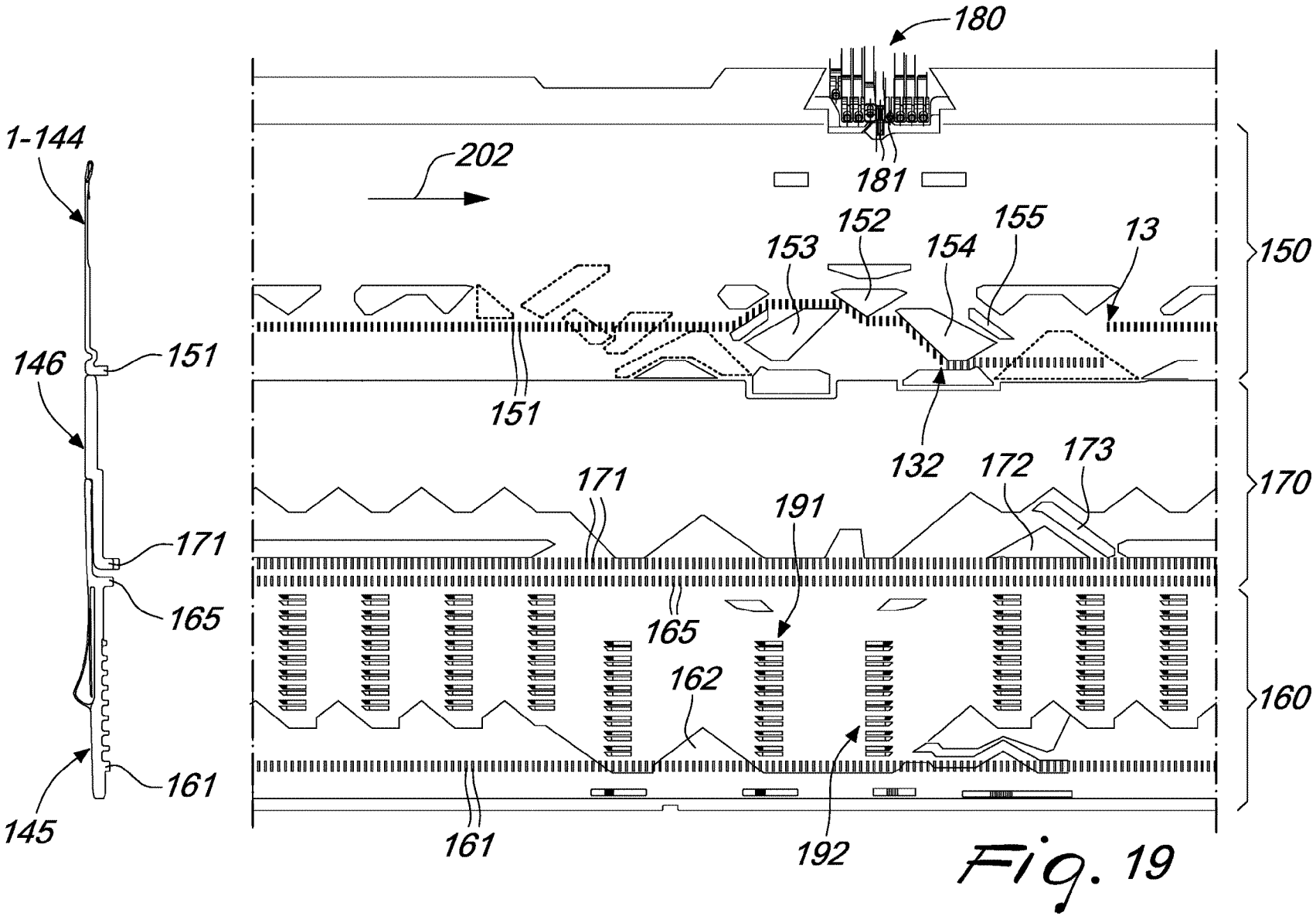

FIGS. 1 to 14 are schematic flat projection views of the needle actuation cams 150, of the sub-needle actuation cams 160 and of the selector actuation cams 170 of the same machine shown in FIGS. 18 and 19. A machine with a single feed 180 and with one hundred and forty-four needles is shown, but the number of feeds, as well as the number of needles, may vary according to the requirements.

A reference numeral from 1 to 144 has been assigned to the needles, and for the sake of simplicity and greater clarity, only the needles required to explain the method according to the invention have been numbered.

In FIGS. 1 to 14, in a manner similar to FIGS. 18 and 19, the reference numeral 152 designates the central cam arranged at the feed 180, where one or more yarn fingers 181 are arranged to dispense at least one yarn which must be taken up by the needles that are moved to knit at the feed 180. In FIGS. 1 to 14, in addition to the cams already identified in FIGS. 18 and 19, the reference numerals 155 and 156 further designate two lifting cams which are arranged above and laterally with respect to the knockover cams 153, 154, and the reference numerals 157 and 158 designate the contrast cams arranged below the knockover cams 153 and 154.

Between the selector actuation cams 160 there is a lifting cam 162, which causes the rise of the selectors 145 that are in the active position and consequently the rise of the needles 1-144 that are in the same axial slots of the needle cylinder up to the tuck-stitch position, when the needle cylinder rotates about its own axis in the direction indicated by the arrow 201, and two lifting cams 163, 167, which cause the rise of the selectors 145 that are in the active position and consequently the lifting of the sub-needles 146 that are in the same axial slots of the needle cylinder when the needle cylinder rotates about its own axis in the direction indicated by the arrow 202. The other selector actuation cams 160 that do not have a significant role in the execution of the method according to the invention have not been numbered and are not described further.

Between the sub-needle actuation cams 170 there is a lifting cam 172, which can be engaged by the sub-needles 146 that have been raised due to the rise of the underlying selector 145 when the selector has engaged the lifting cam 163. The sub-needle lifting cam 172 is such as to cause correspondingly the lifting of the overlying needles 1-144 in the tuck-stitch position. Between the sub-needle actuation cams 170 there are also lowering cams 173 and 174 in order to cancel previous rises of the sub-needles 146 and of the selectors 145.

The other cams that are present in FIGS. 1 to 14, which do not perform a significant role in the execution of the method according to the invention, are not numbered and are not mentioned in the description that follows.

The cams that during the various steps of the method according to the invention are in the inactive position, i.e., spaced from the needle cylinder so as to not interfere with the heels 151, 161, 171 of the needles 1-144 and/or of the selectors 145 and/or of the sub-needles 146 are shown with a profile in dashed lines.

The method according to the invention comprises the following steps:

- identifying a group of contiguous needles in the needle cylinder;
- dividing said group of needles into two contiguous needle subgroups, respectively a first needle subgroup and a second needle subgroup;
- moving to knit at a feed or drop one of the two needle subgroups during the rotation of the needle cylinder in one direction and in the subsequent rotation in the opposite direction so as to form two partial rows of knitting in succession;
- moving to knit at the feed being considered the other needle subgroup of the two needle subgroups during the rotation of the needle cylinder in one direction of rotation and in the subsequent rotation in the opposite direction so as to form two partial rows of knitting in succession;
- proceeding in this manner by alternating, every two partial rows of knitting, the needle subgroup that is moved to knit at the feed being considered for a preset number of partial rows of knitting;

at least one needle of one of the needle subgroups located proximate to the other needle subgroup is moved to knit in the forming of at least one of the two partial rows of knitting formed in each instance by the other needle subgroup so as to provide the interconnection of the partial rows of knitting formed by a needle subgroup with the partial rows of knitting formed by the other needle subgroup.

In the example of execution of the method according to the invention, a circular hosiery knitting machine is used which is provided with one hundred and forty-four needles, of which one hundred and twenty are used for the execution of pouch or heel knitting by actuating the needle cylinder with an alternating motion about its own axis. The group of one hundred and twenty needles is divided into two subgroups, each with sixty needles. The needles of the machine have been designated by the reference numerals 1 to 144. The needles 1 to 12 and the needles 133 to 144 are always excluded from knitting. The needles designated by the reference numerals 72 and 73 are the needles that knit alternately with the needles of their own subgroup or of the other subgroup, so as to provide the interconnection of the partial rows of knitting formed by a needle subgroup with the partial rows of knitting formed by the other needle subgroup, as highlighted in the selection diagram of FIG. 15.

Hereinafter, the rotations of the needle cylinder about its own axis in one direction of rotation or in the opposite direction, which are performed according to center angles of preset breadth, which can vary as a function of the knitting requirements, are also termed oscillations.

In greater detail, the method according to the invention preferably comprises a first step, in which the needle cylinder is actuated in a first direction of rotation or forward direction, designated by the arrow 201, selecting, downstream of the feed 180, the needles of the first subgroup to be moved to knit at the same feed 180 when the needle cylinder is actuated in the second direction of rotation or return direction, which is opposite with respect to the first direction of rotation 201 and is designated by the arrow 202.

Figure 5:
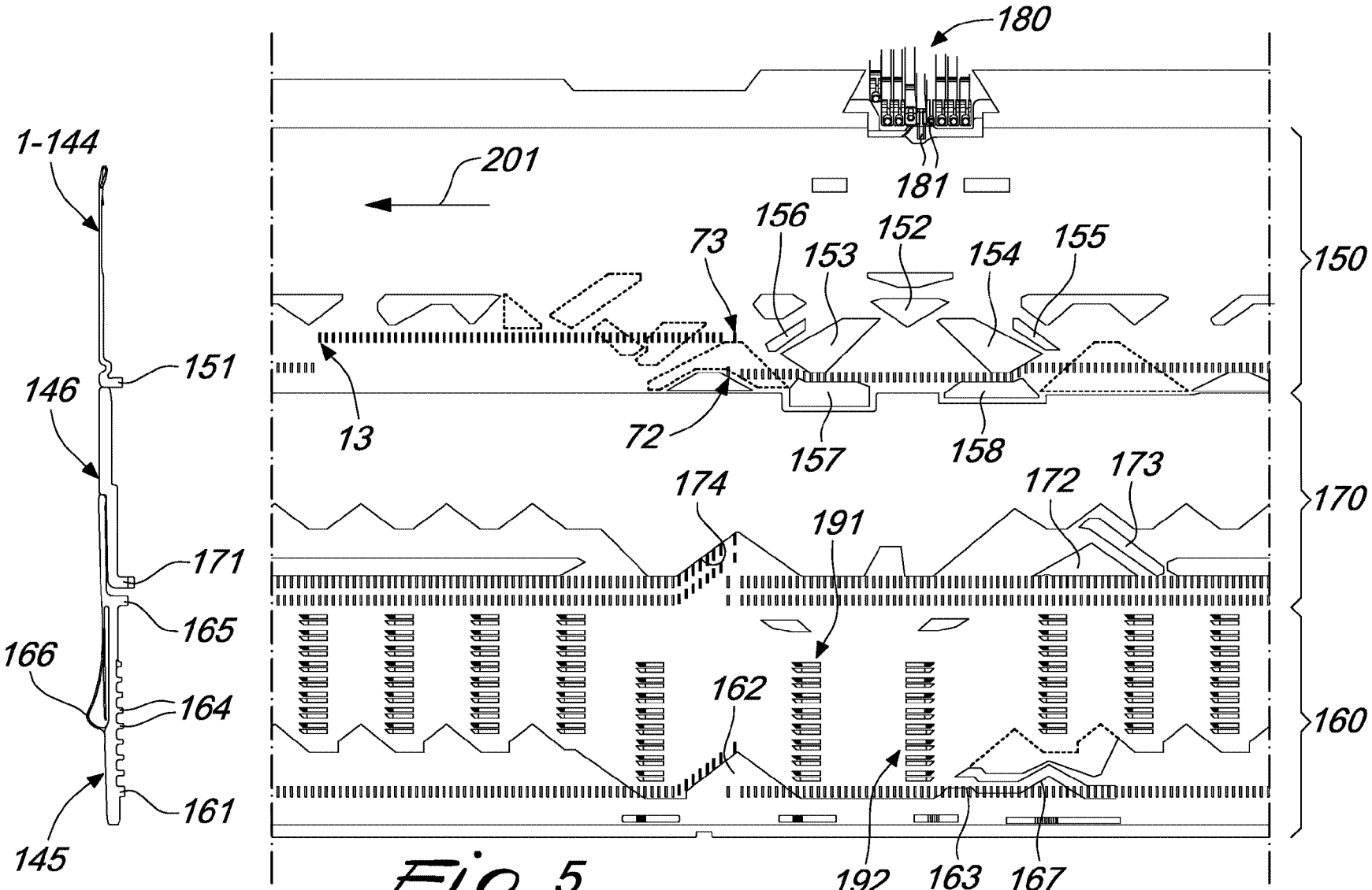

In this first step, shown in FIG. 5, by means of the selection device 191, the needles, from the needle 13 to the needle 73 included, except for needle 72, are selected and raised, as a consequence of the engagement of the selectors 145 with the lifting cam 162, in the tuck-stitch position. Essentially, the needles from needle 13 to needle 73 included, except for the needle 72, are selected according to the selection shown in line D of the diagram shown in FIG. 15, in which the selected needles are represented by a black rectangle and the unselected needles are represented by a white rectangle. During this oscillation of the needle cylinder about its own axis, the needles 1-144 do not form knitting.

Figure 6:
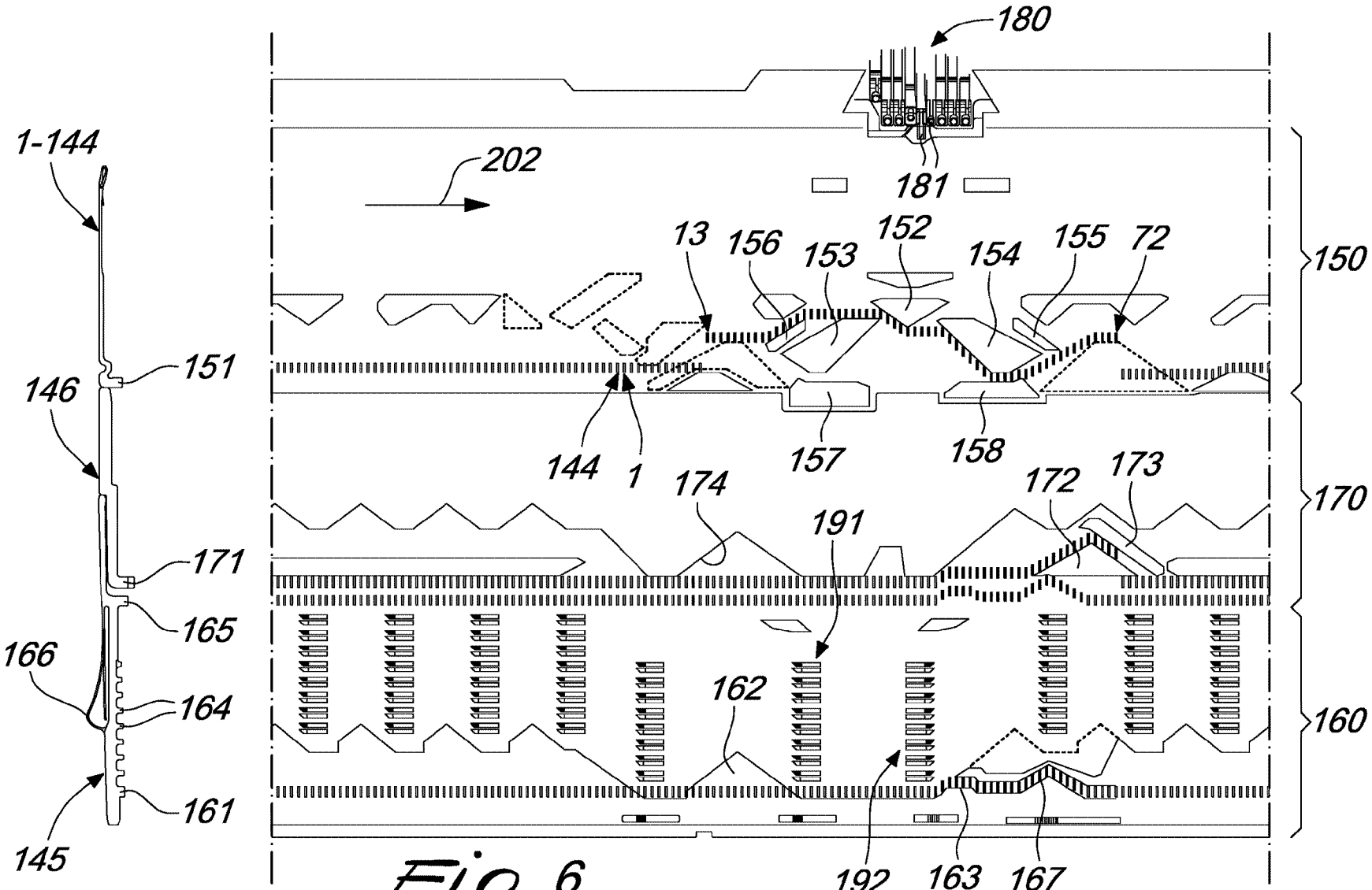
Figure 7:
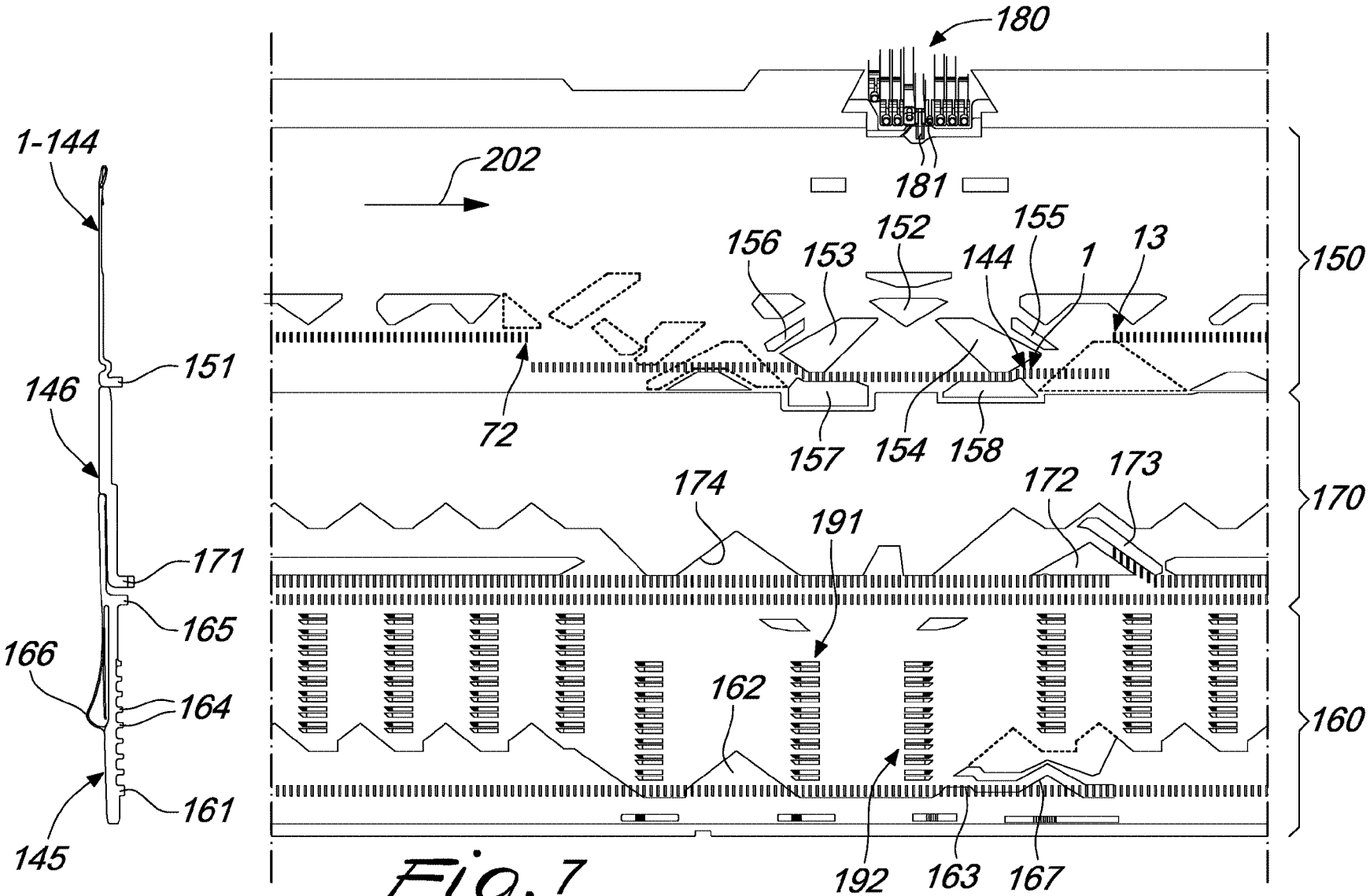

In a second step of the method according to the invention, the needle cylinder reverses its direction of rotation, forming a first partial row of knitting 301 at the feed 180 with the needles that have been selected and moved to the tuck-stitch position in the first step, as shown in FIG. 6. In practice, the needles from needle 13 to needle 73, with the exclusion of needle 72, engage the lifting cam 156, therefore the central cam 152, taking the yarn at the feed 180 being considered, and form new loops of knitting, knocking over the loops formed previously when their heel 151 engages the knockover cam 154. Directly downstream of the knockover cam 154 or thereat, the needles or rather the selectors 145 undergo a new selection, according to the selection shown in line E of the diagram shown in FIG. 15, on the part of the selection device 192 and the needles from needle 72 to needle 13, this time excluding needle 73, are raised to the tuck-stitch position as a consequence of the engagement of the heel 171 of the sub-needles 146 with the lifting cam 172, as shown in FIGS. 6 and 7.

Figure 8:
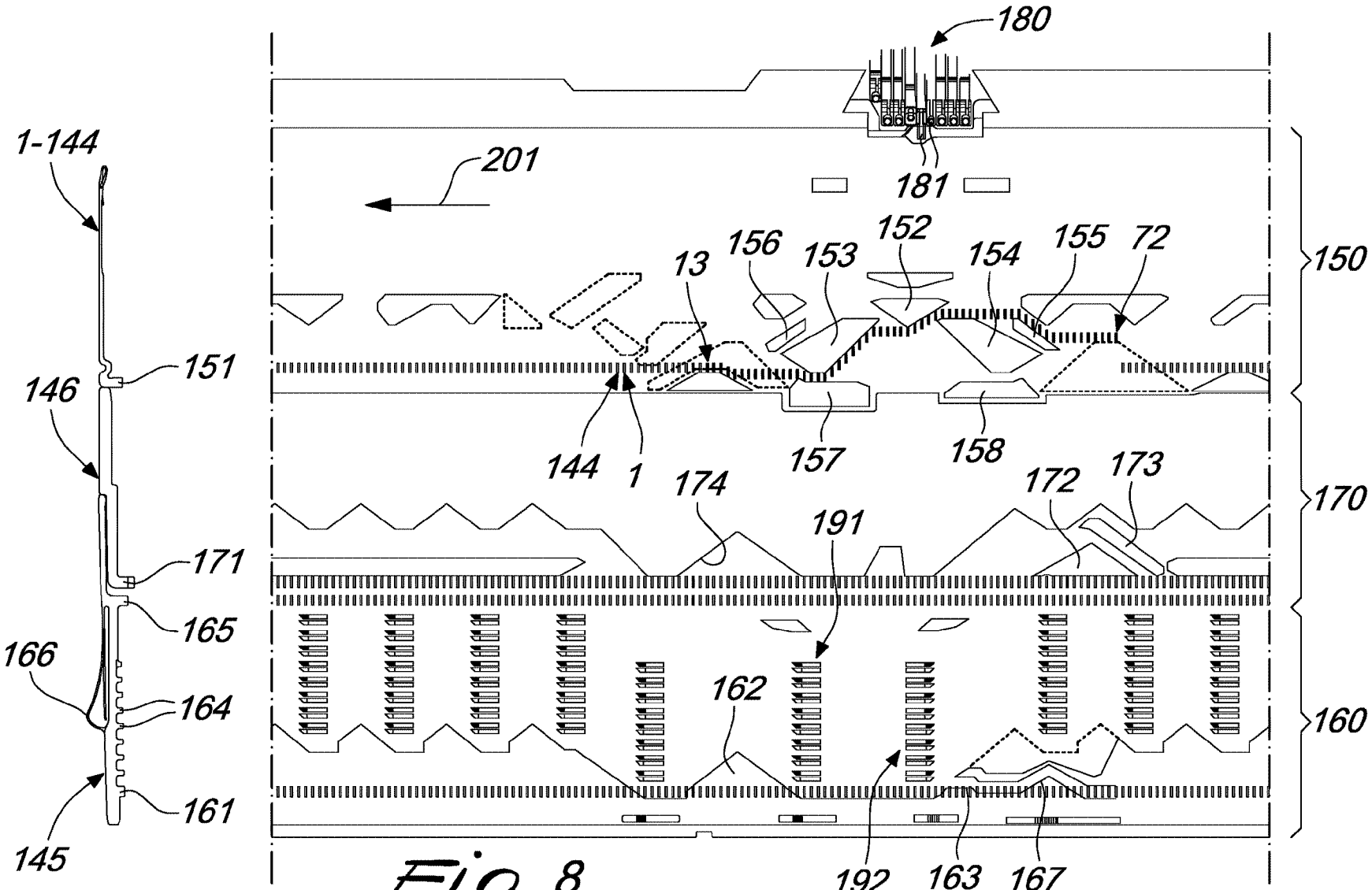
Figure 9:
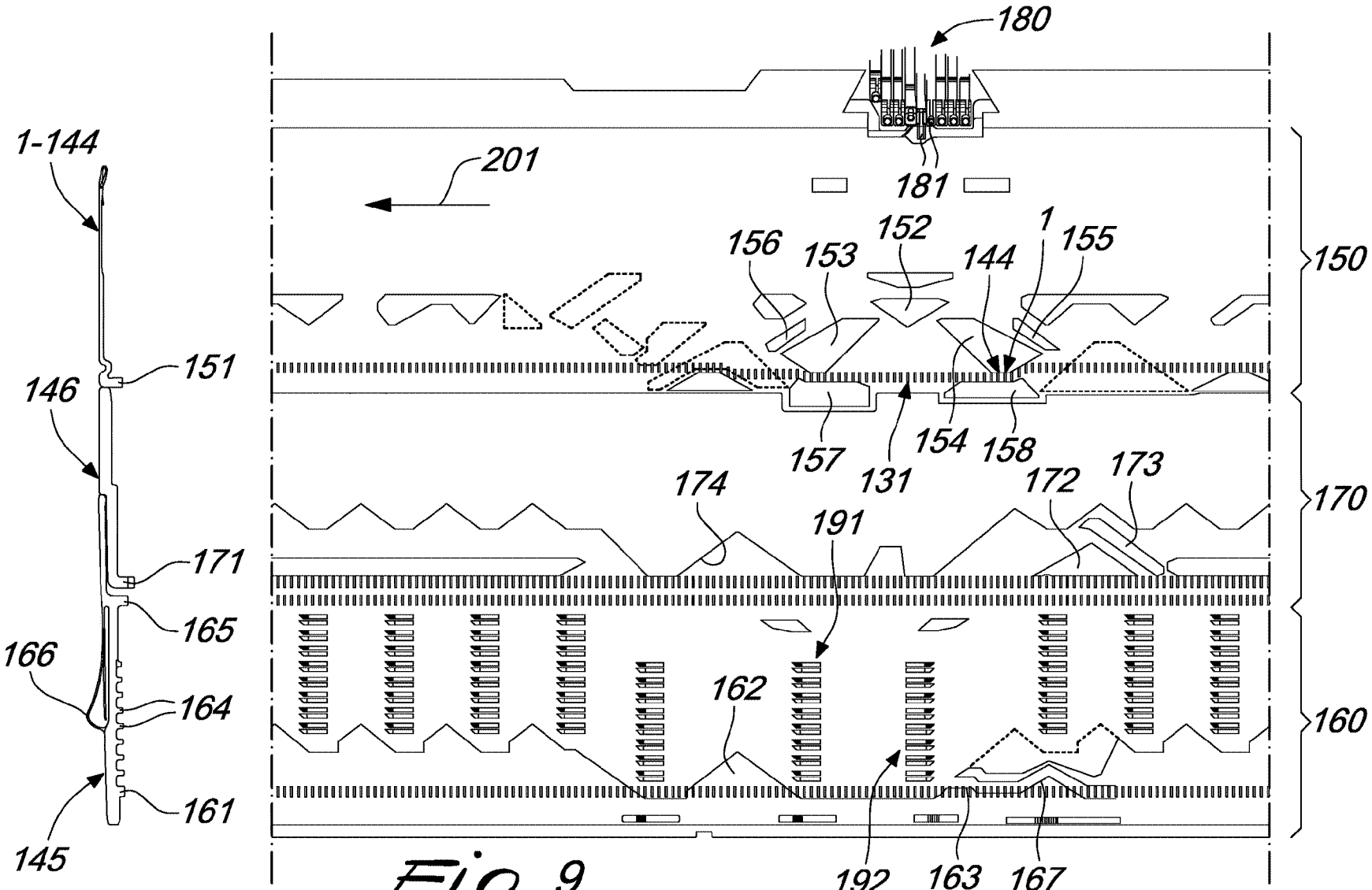

In a third step of the method according to the invention, the needle cylinder is actuated again in the first direction of rotation 201, moving to knit at the feed 180 the needles that have been selected in the second step so as to form a second partial row of knitting 302 with the first needle subgroup, with the needles from needle 13 to needle 72, as an extension of the first partial row of knitting 301 produced with the same first needle subgroup, as shown in FIG. 8. During this oscillation of the needle cylinder in the first direction of rotation 201, no needle selection is performed, as shown in line F of the diagram shown in FIG. 15. In this manner, at the end of this oscillation of the needle cylinder all the needles are in the inactive position, as shown in FIG. 9.

Figure 10:
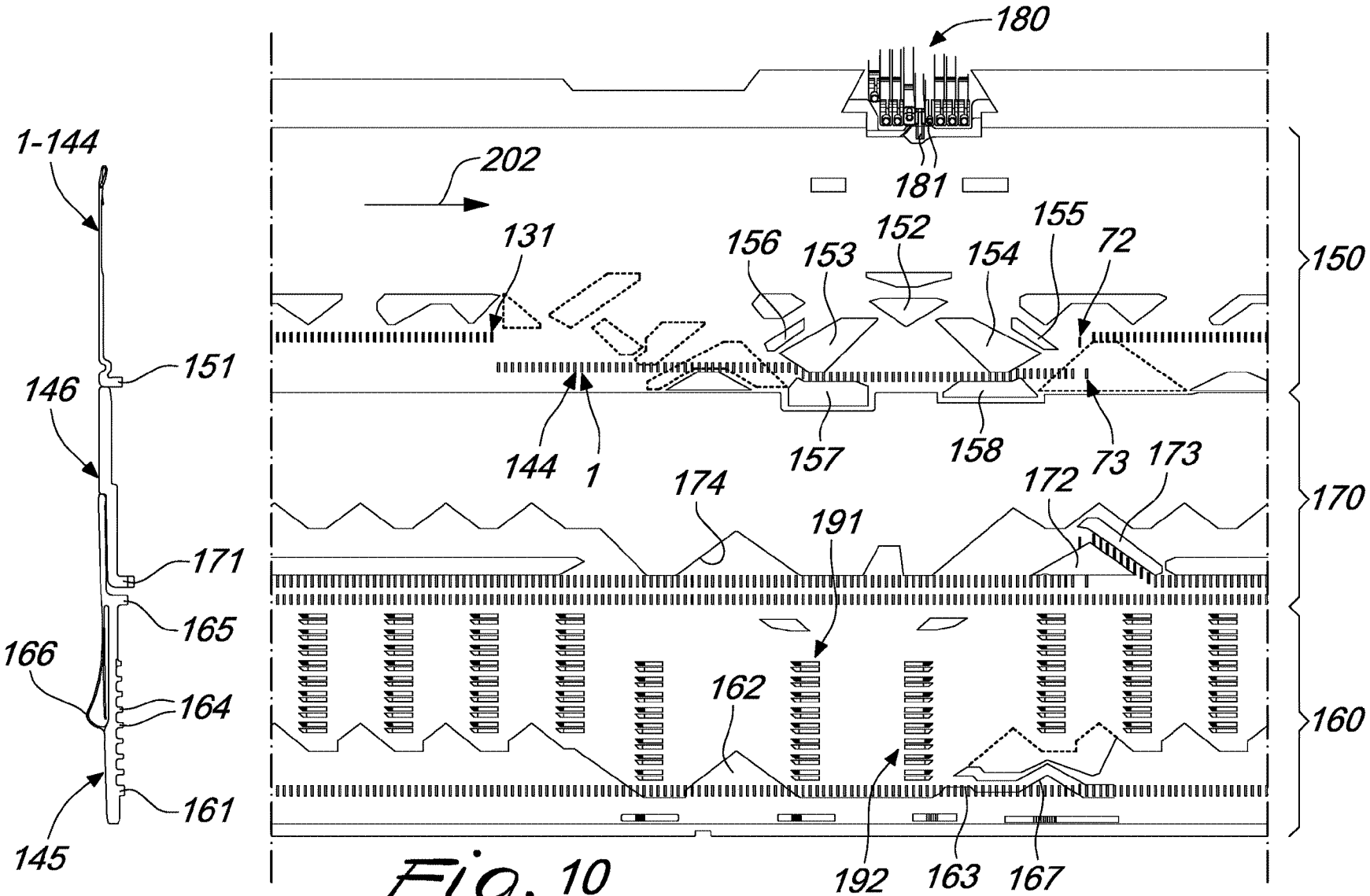

When, in this oscillation of the needle cylinder, the needle 131 has moved beyond the selection device 192, i.e., has passed, to the left in the figures, the selection device 192, the direction of rotation of the needle cylinder is reversed again and the needle cylinder is rotated in the second direction of rotation 202, beginning a fourth step of the method according to the invention. The needles of the second subgroup from the needle 131, except for the needle 73, and together with the needle 72 of the first subgroup, are selected by the selection device 192 and raised to the tuck-stitch position by the engagement of the sub-needles with the lifting cam 172. Essentially, in this step, a selection of the needles is performed as indicated in line G of the diagram shown in FIG. 15. In this fourth step there is no forming of knitting, as shown in FIG. 10.

Figure 11:
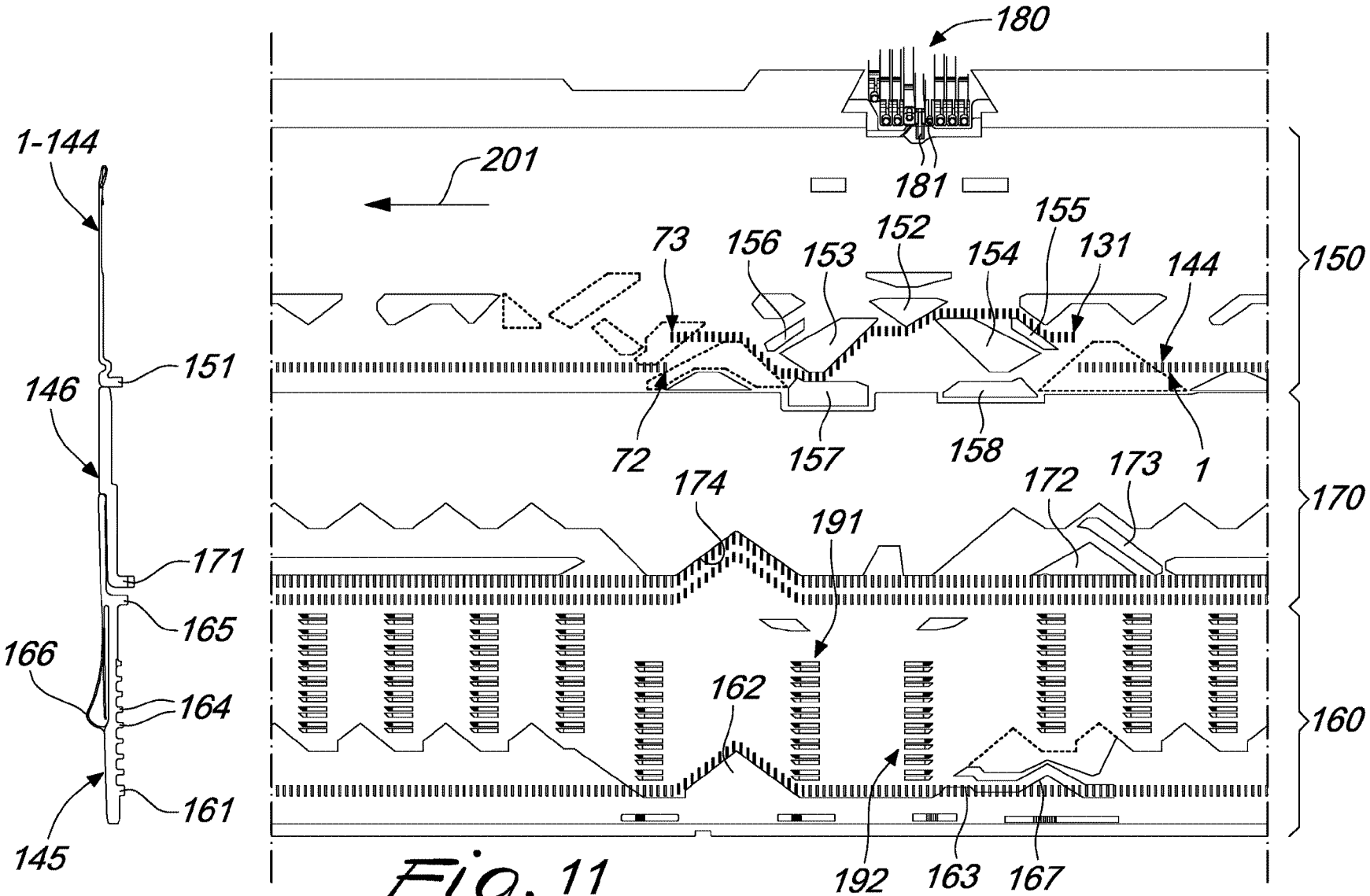
Figure 12:
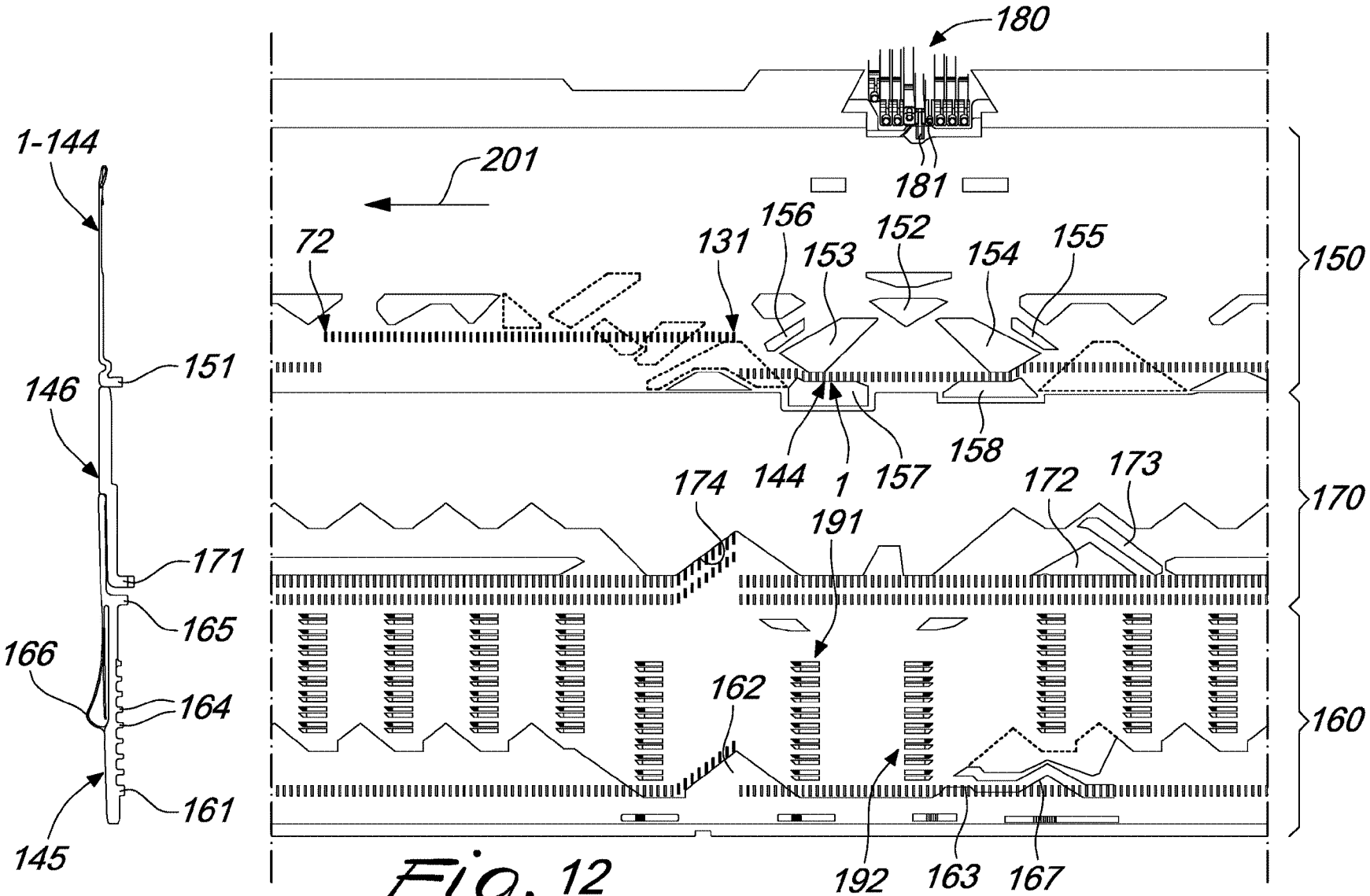

In a fifth step, the direction of rotation of the needle cylinder is reversed again and the needles that had been moved to the tuck-stitch position by means of the selection performed in the fourth step, i.e., the needles from needle 72 to needle 131 with the exclusion of needle 73, form a corresponding first partial row of knitting 303 at the feed 180. Downstream of the knockover cam 153, the needles are selected by means of the selection device 192 as indicated in line H of the diagram shown in FIG. 15. In practice, the needles from needle 73 to needle 131 are moved to the tuck-stitch position, as shown in FIG. 11 and in FIG. 12, which shows the situation of the needles at the end of the oscillation of the needle cylinder in the first direction of rotation 201.

Figure 13:
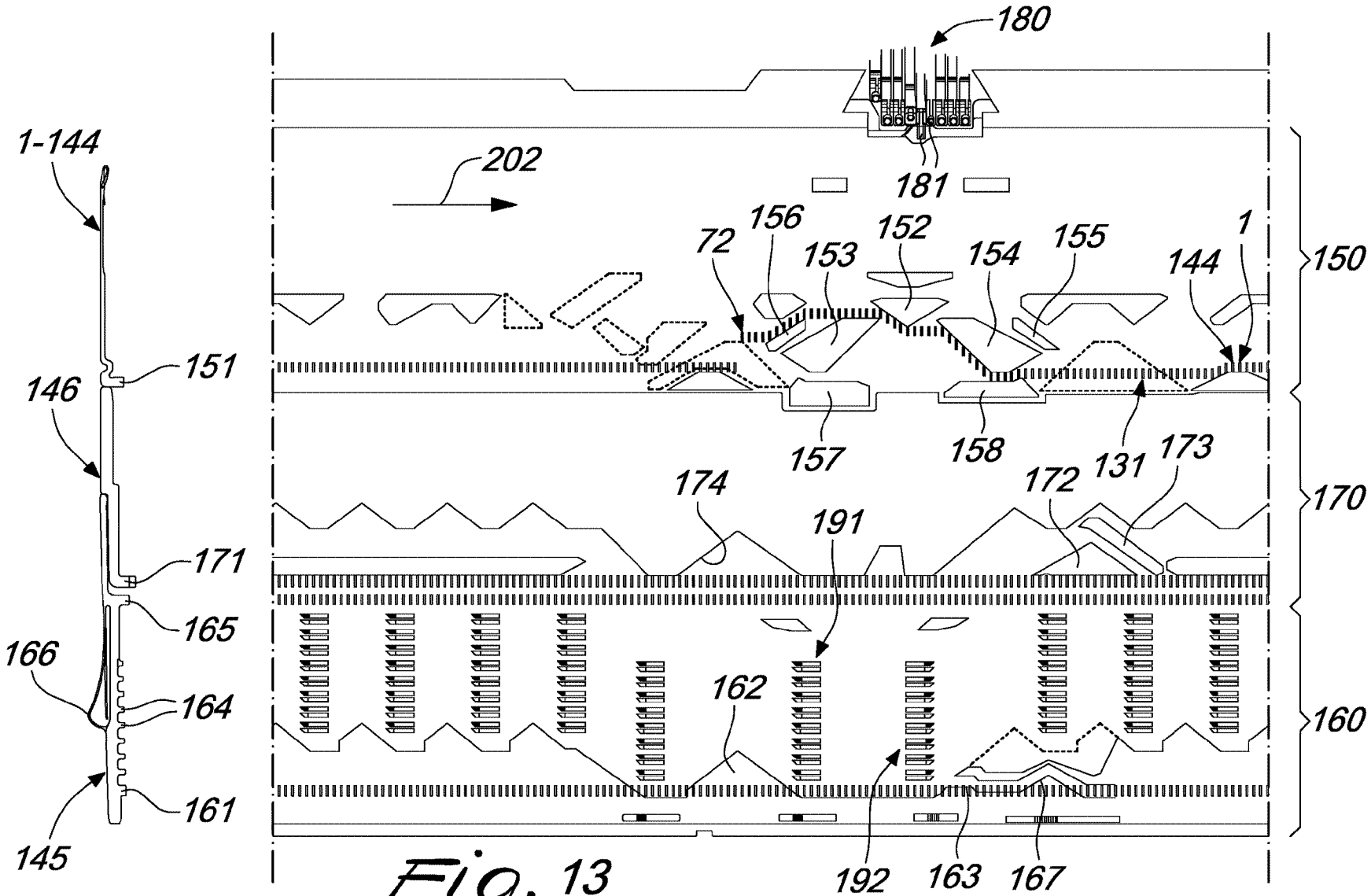
Figure 14:
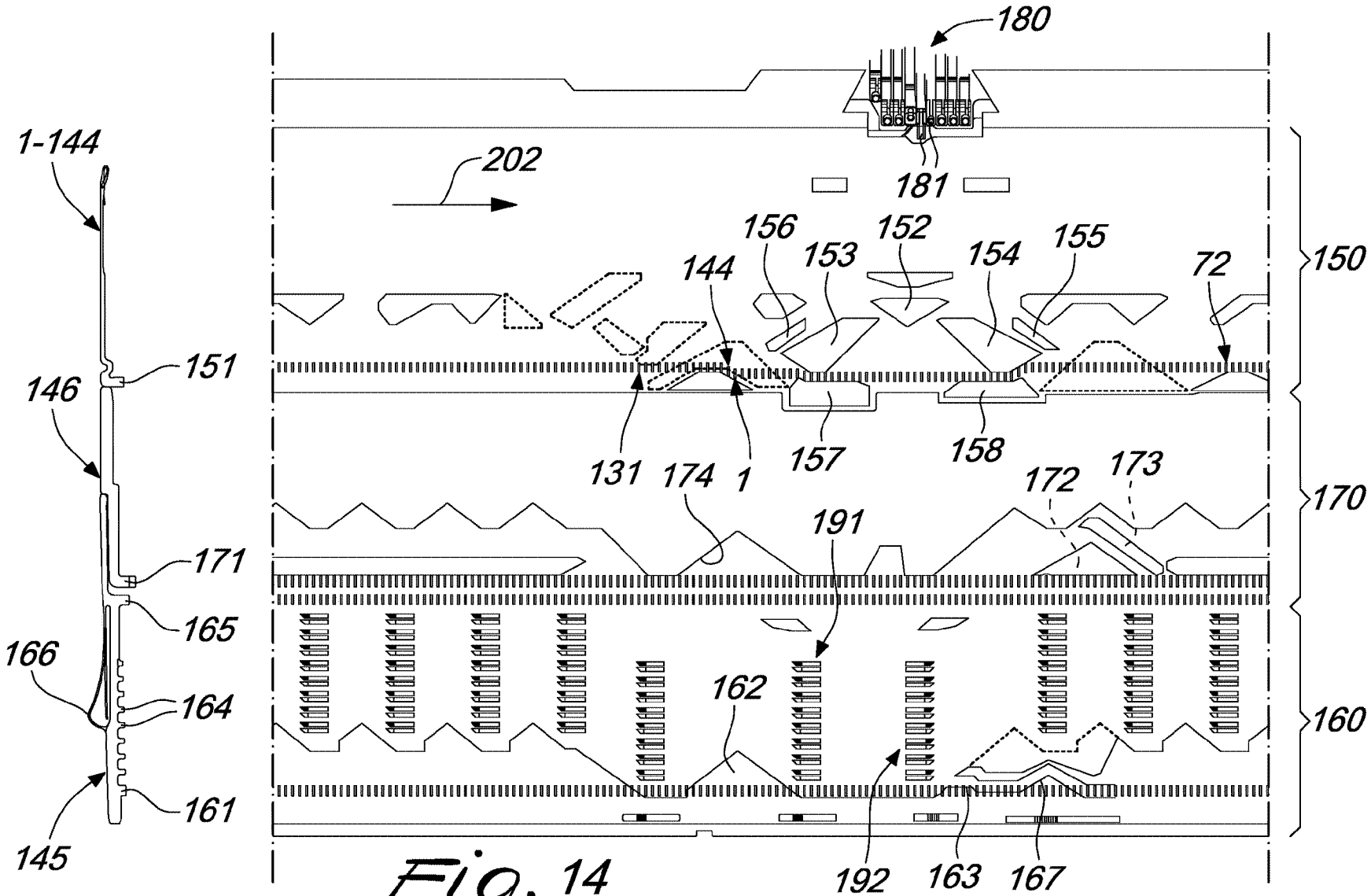

In a sixth step, the direction of rotation of the needle cylinder is reversed again so that the needles that have been moved to the tuck-stitch position in the fifth step, i.e., the needles from needle 131 to needle 72, form a corresponding second partial row of knitting 304, as shown in FIG. 13. In this sixth step, no selection is performed, as indicated by the line I of the diagram shown in FIG. 15. At the end of this oscillation of the needle cylinder in the second direction of rotation 202, all the needles are in the inactive position, as shown in FIG. 14.

At this point the process is repeated as already described from the first step to the sixth step for a preset number of times depending on the extension of the manufacture that one wishes to obtain.

Figure 16:
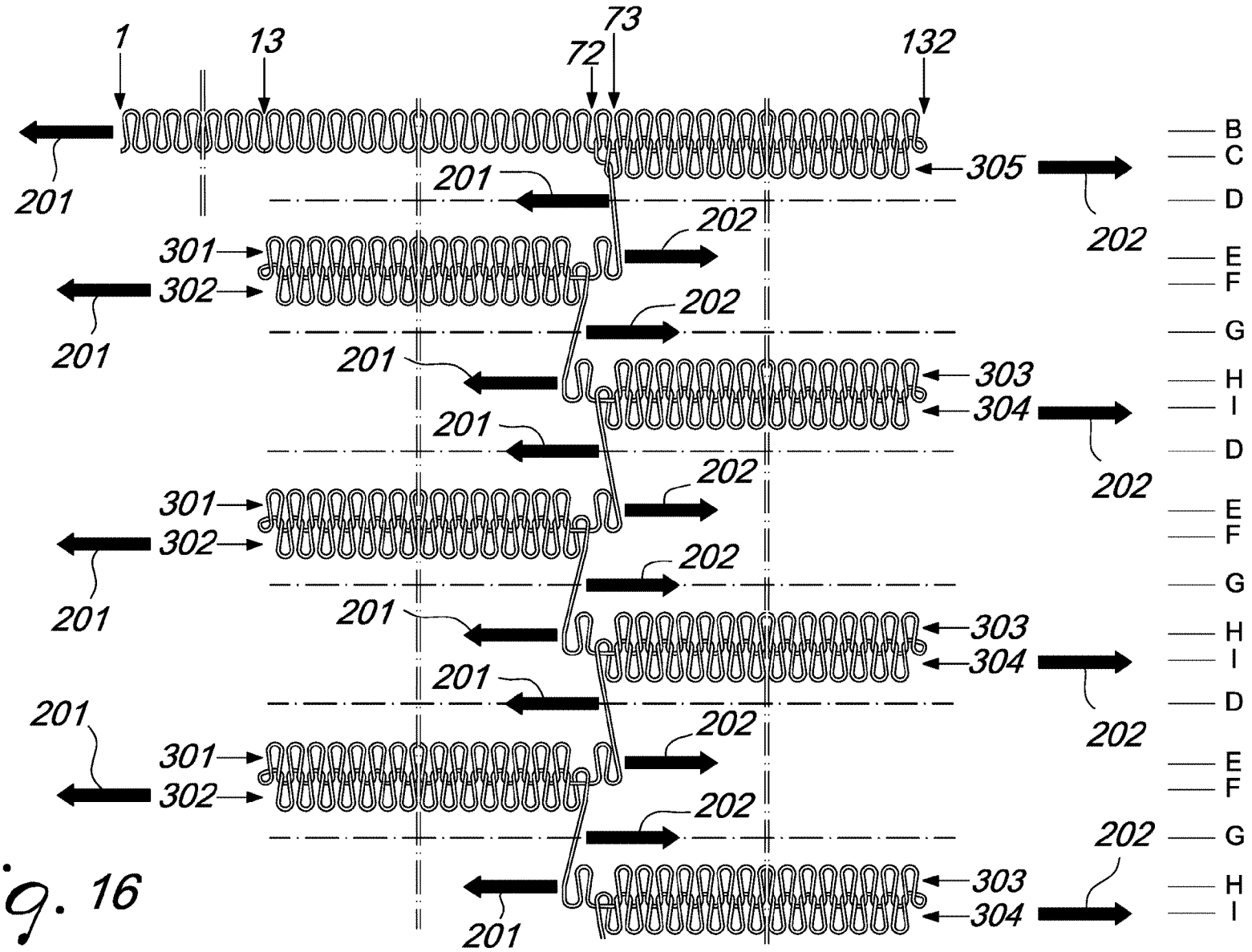
FIG. 16 is a schematic view of the behavior of the yarn knitted by the needles in the forming of a portion of manufacture by means of the to method according to the invention.
Figure 17:
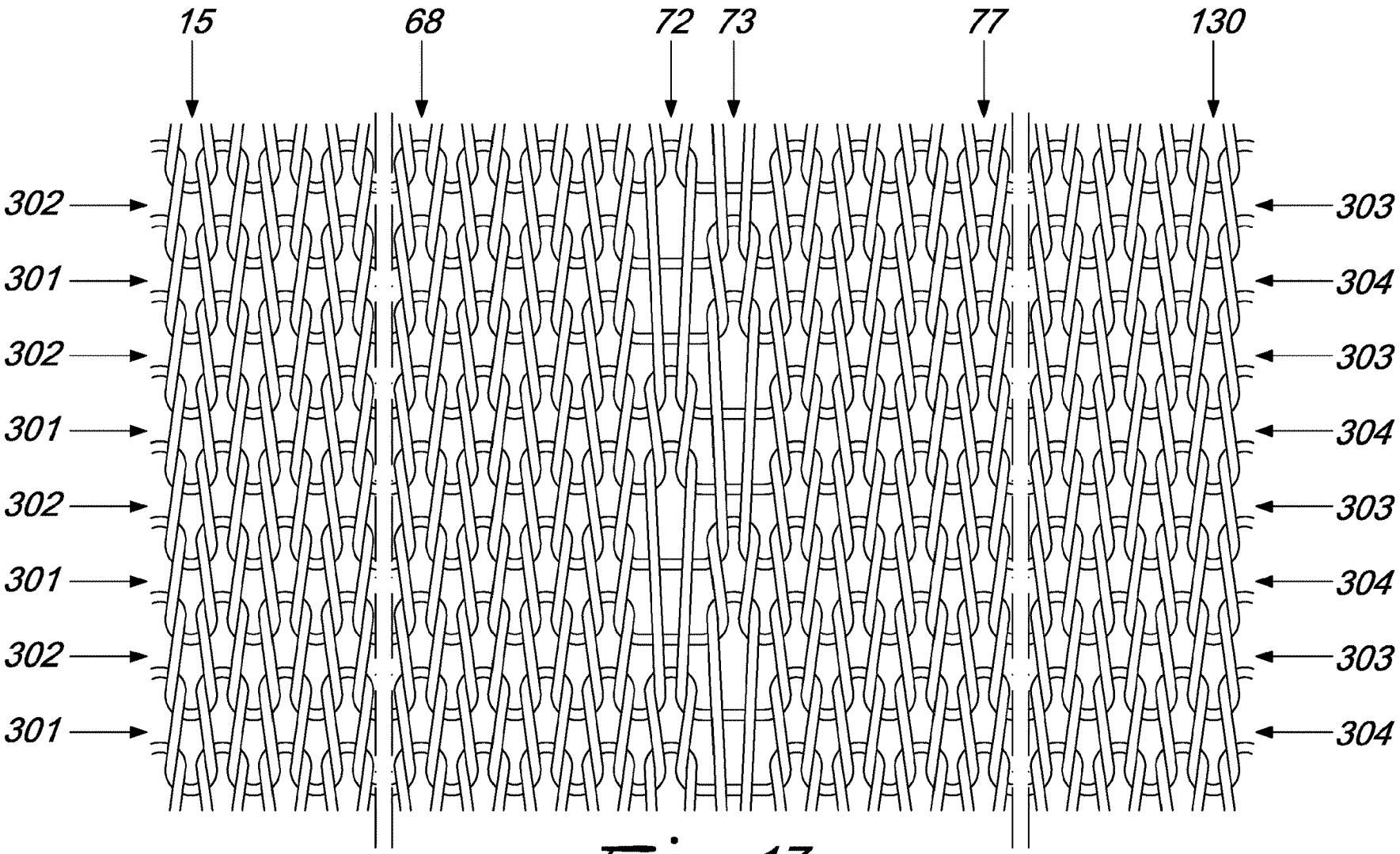
FIG. 17 is a schematic view of an enlarged-scale part of a portion of a manufacture produced by means of the method according to the invention.

As can be noticed in FIGS. 16 and 17, the two subgroups into which the group of needles used for the production of knitting with actuation of the needle cylinder with an alternating rotary motion about its own axis produce, in each instance, two partial rows of knitting 301, 302 and 303, 304, which are produced in succession during an oscillation of the needle cylinder in one direction and during the subsequent oscillation of the needle cylinder in the opposite direction. The partial rows of knitting produced by a needle subgroup are interconnected with the partial rows of knitting produced by the other needle subgroup, making at least one needle of one subgroup knit alternately with the needles of the other subgroup.

In FIG. 16, the partial rows of knitting produced by the respective needle subgroups have been shown uncoupled and spaced vertically in order to better illustrate the execution of the method according to the invention. Of course, in reality the rows of loops of knitting produced by a same needle will be mutually knitted in, as occurs normally in knitting. In said FIG. 16, the lines shown in dots and dashes indicate the oscillations of the needle cylinder without knitting production.

Conveniently, in the transition from the continuous rotation, shown in FIG. 1, to the alternated rotation of the needle cylinder about its own axis, before the first step of the method, the following are performed:

- a first preliminary step, in which the needle cylinder is actuated in the first direction of rotation 201, selecting, downstream of the feed 180, the needles of the second subgroup that must be moved to knit at the feed 180 upon the actuation of the needle cylinder in the second direction of rotation 202;
- a second preliminary step, in which the needle cylinder is actuated in the second direction of rotation 202, moving to knit at the feed 180 the needles that have been selected during the first preliminary step so as to form a preliminary partial row of knitting 305 by means of the second needle subgroup and selecting, downstream of the feed 180, the needles of the first subgroup that must be moved to knit at the feed 180 when the needle cylinder is again rotated in the first direction of rotation 201 in the subsequent first step of the method already described.

Figure 2:
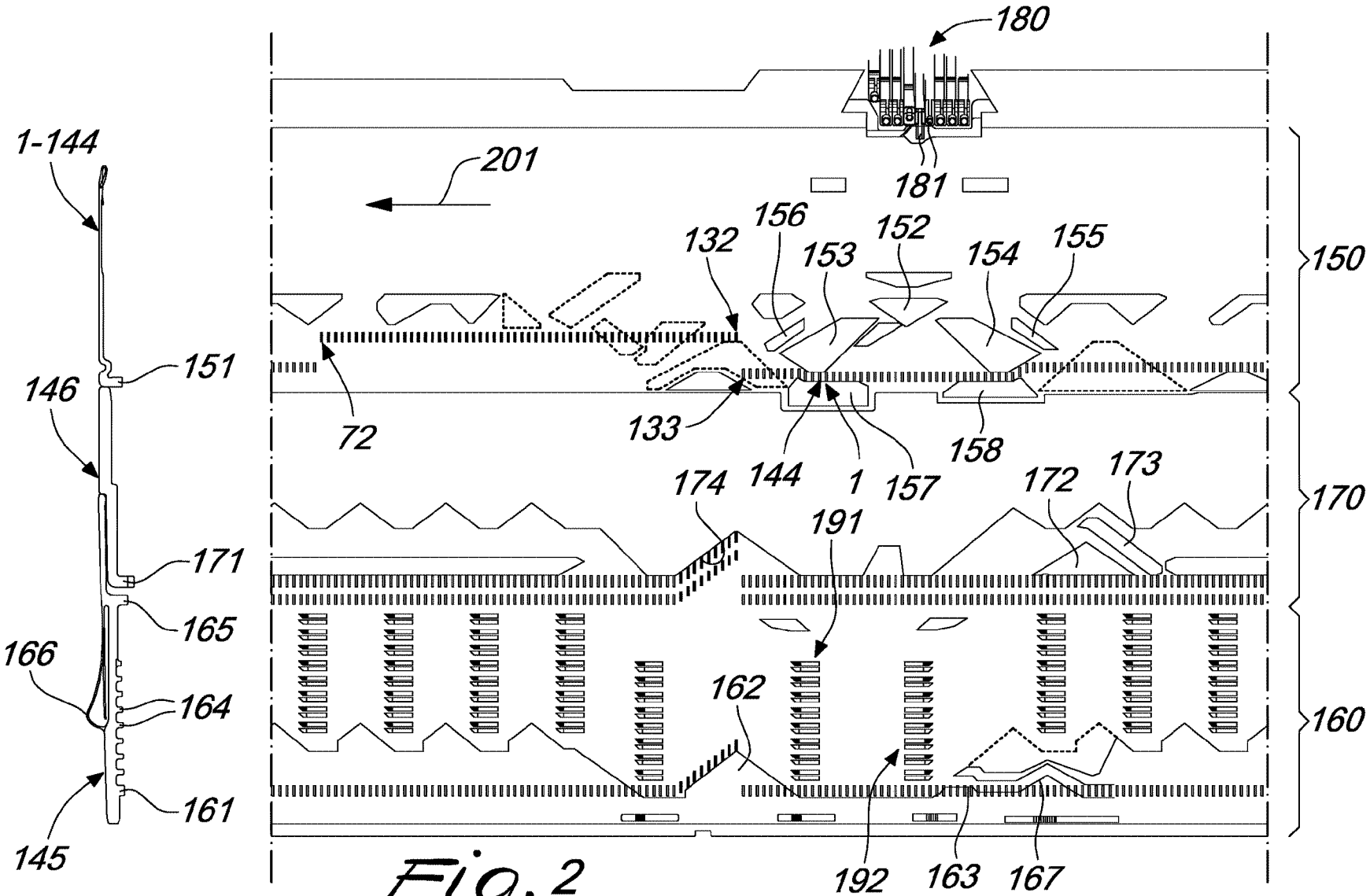
Figure 3:
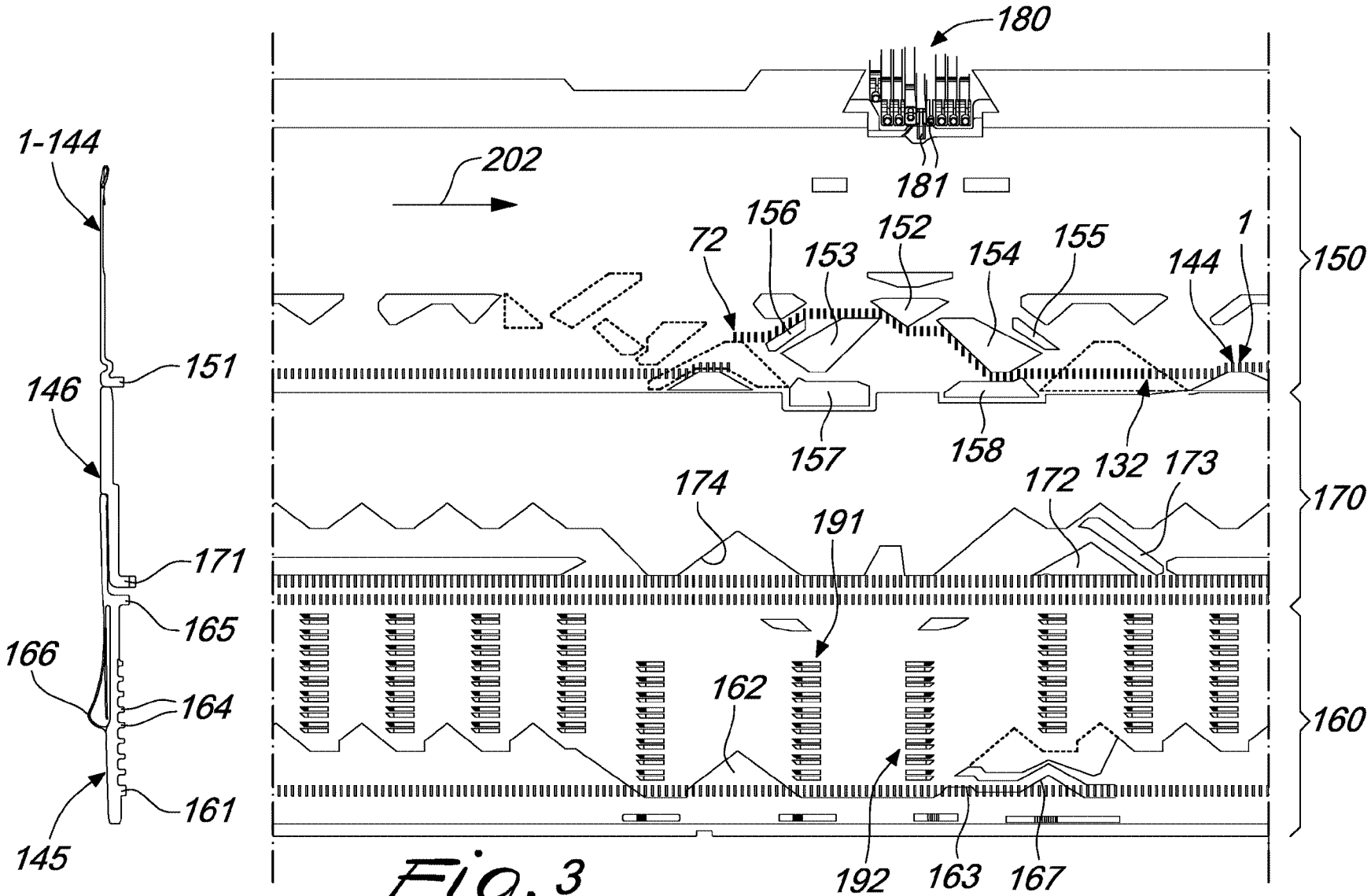
Figure 15:
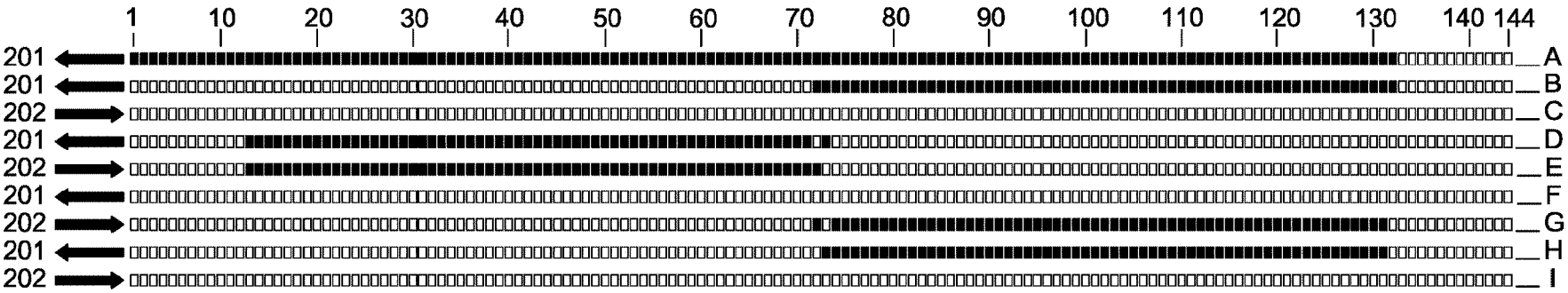
FIG. 15 is a diagram of the selection of the needles in the execution of the various steps of the method according to the invention.

More particularly, after the continuous rotary motion of the needle cylinder about its own axis, in which the needles of the group of needles to be used in knitting with actuation of the needle cylinder with an alternating rotary motion about its own axis are all moved to knit at the feed 180, as shown in line A of the selection diagram of FIG. 15, in the first preliminary step, with the needle cylinder actuated in the first direction of rotation 201 downstream of the knock-over cam 153, the needles of the second subgroup, i.e., the needles from needle 73 to needle 132, and the needle 72 are selected by the selection device 191 according to line B of the diagram of FIG. 15 and are raised to the tuck-stitch position by the engagement of the heels of the corresponding selectors 145 with the lifting is cam 162, as shown in FIG. 2.

Figure 4:
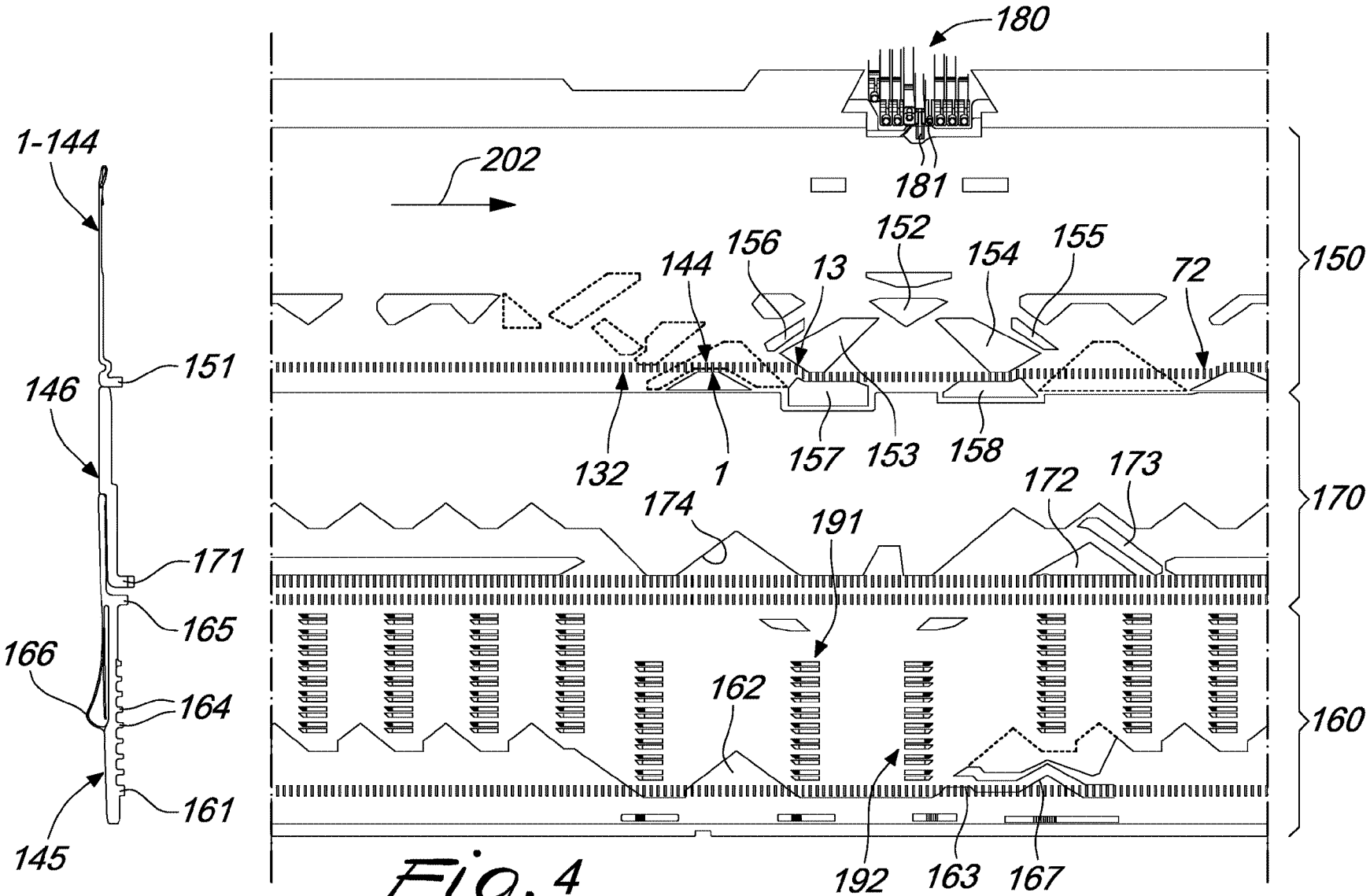

In the second preliminary step, the needle cylinder is actuated with a rotary motion in the second direction of rotation 202 and the needles of the second subgroup, which in the first preliminary step had been selected and moved to the tuck-stitch position, form a first preliminary partial row of knitting 305 at the feed 180. During this oscillation of the needle cylinder about its own axis, no selection is performed, as shown in line C of the selection diagram of FIG. 15. At the end of this oscillation, all the needles are in the inactive position, as shown in FIG. 4. After these preliminary steps, the first step of the method according to the invention begins and knitting continues as already described and illustrated in FIGS. 5 to 14.

As explained above, in some steps of the method according to the invention the oscillation of the needle cylinder performed in these steps is not aimed at producing knitting. This occurs, for example, in the first step and in the fourth step of the method as well as in the subsequent steps that constitute a repetition of these steps.

Execution of these oscillations, which for the sake of simplicity will be referenced as "idle oscillations", is necessary because at the end of the two partial rows of knitting 301, 302 or 303, 304 formed in succession and produced, in the illustrated example, by the needles of the first subgroup that range from needle 13 to needle 72 or of the second subgroup that ranges from needle 73 to needle 132, the yarn is engaged with the needle 73 in the case of the first needle subgroup 13-72 and with the needle 72 in the case of the second needle subgroup 73-132, as shown in FIG. 16 and in the diagram of FIG. 15, lines D and G. In the illustrated example, the needles 72 or 73 are at the center of the group of needles 13-132 used to form the pouch or heel; these needles must provide the interconnection between the two partial rows of knitting 301, 302 formed in succession by the first needle subgroup 13-72 and the two partial rows of knitting 303, 304 formed in succession by the second needle subgroup 73-132. This causes the knitting in of the first partial row of knitting 301 or 303 of the two partial rows of knitting formed in succession by both needle subgroups 13-72 and 73-132 to always begin necessarily at the center of the pouch, i.e., at the needles 72 and 73. Considering for example the sequence of the two partial rows of knitting 301, 302 performed by the first needle subgroup 13-72, as shown in the diagram of FIG. 15, lines E and F, in the second partial row of knitting 302 formed by the first needle subgroup 13-72 the needles that range from needle 13 to needle 72 (diagram of FIG. 15, line E) are selected and moved to the tuck-stitch position with the return rotation direction 202 of the needle cylinder. These needles will form the second partial row of knitting 302 during the subsequent direction of rotation 201 of the needle cylinder (diagram of FIG. 15, line F). At this point, the yarn to be recovered is engaged with the needle 72. If, during the oscillation according to the diagram of FIG. 15 line F, the machine selected the needles of the second subgroup 73-132, the yarn engaged with the needle 72 would not be picked up by the needles, with consequent broken meshes, since, due to the direction of rotation of the needles of the needle cylinder, the needles of the second subgroup 73-132 would have been actuated at the feed being considered before the needle 72, making it impossible to knit in the yarn engaged with the needle 72.

For the sake of greater clarity, FIG. 16 shows the arrows 201 and 202 which indicate the direction of rotation of the needle cylinder, and the lines that correspond to lines A to I of FIG. 15 have been indicated.

Essentially, in the method according to the invention, in the execution of the first partial row of knitting of the sequence of two partial rows of knitting formed by each needle subgroup, the needle cylinder must have the same direction of rotation that it has during the execution of the last partial row of knitting by means of the other needle subgroup; in order to do this, it is necessary to perform an idle oscillation between the end of the sequence of two partial rows of knitting formed by a needle subgroup and the beginning of the sequence of two partial rows of knitting formed by the other needle subgroup.

If the pouch to be formed must begin after a step of continuous rotary motion of the needle cylinder, the last needle that forms the knitting of the last row of knitting formed in continuous motion must be the last one of the group of needles that will form the pouch; in the illustrated example, the pouch is formed by using a group of needles that ranges from needle 13 to needle 132, therefore the last needle that knits in the yarn on the last row of knitting in continuous motion will be needle 132.

FIG. 17 shows schematically a portion of a manufacture produced with the method according to the invention. For the sake of greater simplicity, the rows of knitting have been designated by the numeral of the needle that produced them.

As can be noticed, the manufacture is composed of partial rows of knitting 301, 302 which are produced by the needle subgroup 13 to 72 and by partial rows of knitting 303, 304 produced by the needle subgroup 73 to 132. The partial rows of knitting 301, 302 produced by the needle subgroup 13 to 72 are interconnected with the partial rows of knitting 303,

304 produced by the other needle subgroup 73 to 132, by causing the knitting alternately of at least one needle, in the illustrated case the needles 72, 73 of the needle subgroup respectively 13-72 and 73-132, with the needles respectively 74-132 and 13-71 of the other needle subgroup.

The diagram of FIG. 15 shows a decrease of the needles of the second needle subgroup that are moved to knit during the fourth step of the method. This decrease is a knitting choice which can also be absent, without thereby abandoning the protective scope of the present invention.

Furthermore, preferably, the two needle subgroups have a same number of needles, although the method according to the invention can be performed with two groups of needles that have a different number of needles.

In practice it has been found that the method according to the invention fully achieves the intended aim, since it allows to provide portions of manufacture by means of a circular knitting machine with a needle cylinder that can be actuated with an alternating rotary motion about its own axis by using a large number of needles, in an extreme case equal to the number of needles of the machine, even with circular machines that perform selection of the needles to be moved to knit during the rotary motion of the needle cylinder in one direction, during the rotation of the needle cylinder in the directly preceding opposite direction.

The method thus conceived is susceptible of numerous modifications and variations, all of which are within the scope of the appended claims; all the details may further be replaced with other technically equivalent elements.

In practice, the materials used, as well as the dimensions, may be any according to the requirements and to the state of the art.

The disclosures in Italian Patent Application No. 102018000002290 from which this application claims priority are incorporated herein by reference.

Where technical features mentioned in any claim are followed by reference signs, those reference signs have been included for the sole purpose of increasing the intelligibility of the claims and accordingly such reference signs do not have any limiting effect on the interpretation of each element identified by way of example by such reference signs.

The invention claimed is:

1. A method for the production of portions of manufacture by means of a circular knitting machine with needle cylinder that can be actuated with an alternating rotary motion about its own axis, wherein said needle cylinder has, on its lateral surface, a plurality of axial slots, in each of which a needle is accommodated, a drop or feed being arranged around said needle cylinder and at least one yarn being dispensed thereat which can be engaged by the needles in order to form knitting, means being provided for the actuation of the needles along the corresponding axial slot in order to grip the yarn at said drop or feed and form loops of knitting, selection devices being provided for selecting the needles to be moved to knit at said at least one feed, said selection devices comprising a first selection device and a second selection device, which are arranged on mutually opposite sides with respect to said feed, said selection devices being adapted to select the needles downstream of said feed depending on the direction of rotation of the needle cylinder about its own axis, the method comprising the following steps:

identifying a group of contiguous needles in the needle cylinder;

dividing said group of needles into two contiguous needle subgroups, respectively a first needle subgroup and a second needle subgroup;

moving to knit at said feed a needle subgroup of said two needle subgroups during a rotation of the needle cylinder in one direction and in the subsequent rotation in an opposite direction to form two partial rows of knitting in succession;

moving to knit at said feed the other needle subgroup of said two needle subgroups during the rotation of the needle cylinder in one direction of rotation and in the subsequent rotation in the opposite direction to form two partial rows of knitting in succession;

proceeding in this manner by alternating, every two partial rows of knitting, the needle subgroup that is moved to knit at said feed for a preset number of partial rows of knitting;

at least one needle of a needle subgroup of said needle subgroups, located proximate to the other needle subgroup, being moved to knit in the forming of at least one of the two partial rows of knitting formed in each instance by the other needle subgroup for the interconnection of the partial rows of knitting formed by a needle subgroup with the partial rows of knitting formed by the other needle subgroup.

2. The method according to claim 1, further comprising:

a first step, in which the needle cylinder is actuated in a first direction of rotation or forward direction by selecting, downstream of said feed, the needles of said first needle subgroup to be moved to knit at said feed in the actuation of the needle cylinder in a second direction of rotation or return direction, no forming of knitting being performed in said first step by the needles of said group of needles;

a second step, in which the needle cylinder is actuated in the second direction of rotation, moving to knit at said feed the needles selected in said first step in order to form a first partial row of knitting of the first needle subgroup and selecting, downstream of said feed, the needles of said first needle subgroup to be moved to knit at said feed in the first direction of rotation;

a third step, in which the needle cylinder is actuated in the first direction of rotation, moving to knit at said feed the needles of said first needle subgroup selected in said second step in order to form a second partial row of knitting of the first needle subgroup as a continuation of said first partial row of knitting of the first needle subgroup;

a fourth step, in which the needle cylinder is actuated in the second direction of rotation by selecting, downstream of said feed, the needles of said second needle subgroup to be moved to knit at said feed in the actuation of the needle cylinder in the first direction of rotation, no forming of knitting being performed in said fourth step on the part of the needles of said group of needles;

a fifth step, in which the needle cylinder is actuated in the first direction of rotation, moving to knit at said feed the needles of said second needle subgroup selected in said fourth step in order to form, a first partial row of knitting of the second needle subgroup and selecting, downstream of said feed, the needles of said second group to be moved to knit at said feed in the actuation of the needle cylinder in the second direction of rotation;

a sixth step, in which the needle cylinder is actuated in the second direction of rotation, moving to knit at said feed the needles selected in said fifth step in order to form a second partial row of knitting of the second needle subgroup as a continuation of said first partial row of knitting of the second needle subgroup;

said steps being repeated a preset number of times depending on the number of rows of knitting to be provided.

3. The method according to claim 1, wherein in said first step, together with the needles of said first needle subgroup, at least one needle of said second needle subgroup that is contiguous to said first needle subgroup is also selected as a replacement of at least one needle of said first needle subgroup contiguous thereto that is not selected, and, in said second step, said at least one needle of said second needle subgroup being moved to knit at said feed in order to form knitting together with the needles of said first needle subgroup selected in said first step;

in said second step, downstream of said feed, said at least one needle of said second needle subgroup being no longer selected and said at least one needle of said first needle subgroup previously excluded from selection in said first step being selected instead.

4. The method according to claim 2, wherein in said fourth step, together with the needles of said second needle subgroup, at least one needle of said first needle subgroup that is contiguous to said second needle subgroup is also selected as a replacement of at least one needle of said second needle subgroup contiguous thereto that is not selected, and, in said fifth step, said at least one needle of said first needle subgroup being moved to knit at said feed in order to form knitting together with the needles of said second needle subgroup selected in said fourth step;

in said fifth step, downstream of said feed, said at least one needle of said first needle subgroup being no longer selected and said at least one needle of said second needle subgroup previously excluded from selection in said fourth step being selected instead.

5. The method according to claim 1, wherein during a transition from continuous rotation to alternating rotation of the needle cylinder about its own axis, before said first step, the following steps are performed:

a first preliminary step, in which the needle cylinder is actuated in the first direction of rotation, selecting, downstream of said feed, the needles of said second needle subgroup to be moved to knit at said feed in the actuation of the needle cylinder in the second direction of rotation;

a second preliminary step, in which the needle cylinder is actuated in the second direction of rotation, moving to knit at said feed the needles selected in said first preliminary step in order to form a preliminary partial row of knitting of the second needle subgroup and selecting, downstream of said feed, the needles of said first needle subgroup to be moved to knit at said feed in the first direction of rotation in the subsequent first step.

6. The method according to claim 5, wherein in said first preliminary step, together with the needles of said second needle subgroup, at least one needle of said first needle subgroup contiguous to said second needle subgroup is also selected.

7. The method according to claim 1, wherein said first needle subgroup and said second needle subgroup have substantially the same number of needles.

* * * * *